US007418225B2

(12) United States Patent
Morioka et al.

(10) Patent No.: US 7,418,225 B2
(45) Date of Patent: Aug. 26, 2008

(54) DEVELOPING APPARATUS, PROCESS CARTRIDGE, ELECTROPHOTOGRAPHIC IMAGE FORMING APPARATUS AND END PORTION REGULATING MEMBER

(75) Inventors: Masanari Morioka, Shizouka (JP); Yoshiyuki Batori, Shizouka (JP); Hiroki Ogino, Shizouka (JP)

(73) Assignee: Canon Kabushiki Kaisha, Tokyo (JP)

( * ) Notice: Subject to any disclaimer, the term of this patent is extended or adjusted under 35 U.S.C. 154(b) by 192 days.

(21) Appl. No.: 10/985,930

(22) Filed: Nov. 12, 2004

(65) Prior Publication Data

US 2005/0105936 A1 May 19, 2005

(30) Foreign Application Priority Data

Nov. 17, 2003 (JP) ..... 2003-386310

(51) Int. Cl.
*G03G 15/09* (2006.01)

(52) U.S. Cl. ..... 399/274

(58) Field of Classification Search ..... 399/103, 399/274

See application file for complete search history.

(56) References Cited

U.S. PATENT DOCUMENTS

| | | | | |
|---|---|---|---|---|
| 5,911,096 | A | 6/1999 | Batori et al. | 399/111 |
| 5,920,753 | A | 7/1999 | Sasaki et al. | 399/111 |
| 5,930,562 | A | 7/1999 | Noda et al. | 399/114 |
| 5,937,237 | A | 8/1999 | Nonaka et al. | 399/106 |
| 5,940,658 | A | 8/1999 | Yokoi et al. | 399/119 |
| 6,070,037 | A | 5/2000 | Sugihara et al. | 399/274 |
| 6,075,957 | A | 6/2000 | Batori et al. | 399/114 |
| 6,101,348 | A | 8/2000 | Nonaka et al. | 399/103 |
| 6,131,007 | A | 10/2000 | Yamaguchi et al. | 399/256 |
| 6,205,304 | B1 | 3/2001 | Kawaguchi | 399/103 |
| 6,275,668 | B1 | 8/2001 | Batori | 399/90 |
| 6,334,035 | B1 | 12/2001 | Abe et al. | 399/106 |
| 6,363,226 | B1 | 3/2002 | Batori | 399/8 |
| 6,704,522 | B2 | 3/2004 | Sasago et al. | 399/12 |

(Continued)

FOREIGN PATENT DOCUMENTS

JP 2000-98738 4/2000

(Continued)

OTHER PUBLICATIONS

Notification of Reason for Refusal, issued Jan. 10, 2006 in Japanese Application No. 2003-386310 and English translation thereof.

(Continued)

*Primary Examiner*—Diego Gutierrez
*Assistant Examiner*—Amy He
(74) *Attorney, Agent, or Firm*—Fitzpatrick, Cella, Harper & Scinto

(57) ABSTRACT

A developing apparatus, a process cartridge and an electrophotographic image forming apparatus which can obtain a good image, and an end portion regulating member provided in them. The end portion regulating members for regulating the layer thickness of developer passed through interstices between a developing blade for forming a layer of the developer having a predetermined thickness on the surface of a developing roller and magnetic seals provided on the longitudinally opposite end portions of the developing roller in opposed relationship with the surface of the developing roller is provided downstream of the developing blade with respect to the rotating direction of the developing roller.

17 Claims, 17 Drawing Sheets

U.S. PATENT DOCUMENTS

| | | | | |
|---|---|---|---|---|
| 6,708,010 | B2 | 3/2004 | Miyabe et al. | 399/104 |
| 6,714,746 | B2 | 3/2004 | Morioka et al. | 399/27 |
| 6,963,714 | B2 * | 11/2005 | Otomo et al. | 399/274 |
| 2003/0235429 | A1 | 12/2003 | Sato et al. | 399/111 |
| 2004/0013446 | A1 | 1/2004 | Morioka et al. | 399/111 |
| 2004/0037590 | A1 | 2/2004 | Morioka et al. | 399/167 |

FOREIGN PATENT DOCUMENTS

| | | |
|---|---|---|
| JP | 2000-131926 | 5/2000 |
| JP | 2001-350344 | 12/2001 |
| JP | 2003-015413 | 1/2003 |
| JP | 2003-177603 | 6/2003 |
| JP | 2003-208018 | 7/2003 |

OTHER PUBLICATIONS

Decision of Rejection issued Sep. 19, 2006 in Japanese Application No. 2003-386310 and English translation thereof.

* cited by examiner

DEVELOPING APPARATUS, PROCESS CARTRIDGE, ELECTROPHOTOGRAPHIC IMAGE FORMING APPARATUS AND END PORTION REGULATING MEMBER

BACKGROUND OF THE INVENTION

1. Field of the Invention

The invention relates to a developing apparatus, a process cartridge, an electrophotographic image forming apparatus and an end portion regulating member.

2. Description of Related Art

Heretofore, a process cartridge system has been adopted in an electrophotographic image forming apparatus using an electrophotographic image forming process. This process cartridge system refers to a system whereby an electrophotographic photosensitive member and process means acting on the electrophotographic photosensitive member are integrally made into a cartridge, which is made detachable mountable to a main body of an image forming apparatus. According to this process cartridge system, the maintenance of the apparatus can be done by an operator himself without resort to a serviceman. Therefore the operability of the apparatus can be markedly improved. So, this process cartridge system is widely used in electrophotographic image forming apparatuses.

Also, in a developing apparatus used in the electrophotographic image forming apparatus, a stationary magnet is disposed in a hollow cylindrical developing roller. By the magnetic force of the magnet, a developer (hereinafter referred to as the "toner") is attracted to the surface of the developing roller. The layer thickness of the toner adhering to the surface of the developing roller is regulated by a developing blade. By the developing roller being rotated, the toner is carried to a developing portion for visualizing a latent image.

As a method of preventing this toner from leaking out of a developing chamber, there is known a method of bringing a seal member such as belt into contact with the developing roller within the range outside an image formable area.

Also, there is known a method of disposing a ferromagnetic material as a seal member in non-contact with the developing roller, and holding the toner by the magnetic force thereof.

Also, there is known a construction in which a scraping-off member is disposed downstream of a seal member with respect to the rotating direction of the developing roller and a portion of the scraping-off member is brought into contact with the developing roller. This scraping-off member returns the toner having come out from the aforementioned seal member to the downstream side by the rotation of the developing roller again into a developing area so as not to leak outwardly (U.S. Pat. No. 6,205,304).

However, it has sometimes been the case that the developer leaks out along the rotating direction of the developing roller through interstices formed between the developing blade and the seal members provided on the end portions of the developing roller. When the amount of the developer leaking out through the interstices increases, there has been the possibility of the developer adhering to the electrophotographic photosensitive member.

SUMMARY OF THE INVENTION

The present invention is the further development of the above-described conventional example.

It is an object of the present invention to regulate the developer leaking out along the rotating direction of a developing roller through interstices formed between a developing blade and seal members provided on the end portions of a developing roller.

It is another object of the present invention to decrease the amount of the developer unnecessarily adhering to an electrophotographic photosensitive member.

It is another object of the present invention to provide a developing apparatus, a process cartridge and an image forming apparatus which can obtain a good image, and an end portion regulating member provided in them.

It is another object of the present invention to provide a regulating portion for regulating the layer thickness of a developer when the layer thickness of the developer passed through an interstice formed between a layer thickness regulating member and a seal member in a longitudinal direction is a predetermined or greater layer thickness, and permitting the passage of the developer when the layer thickness of the developer is less than the predetermined layer thickness, the regulating portion having a gap with respect to the surface of a developing roller, downstream of a layer thickness regulating member with respect to the rotating direction of the developing roller.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

The best form for carrying out this invention will hereinafter be described with reference to the drawings and embodiments. However, the numerical values, materials, shapes, relative arrangements, etc. of constituent parts described in these embodiments are not intended to restrict the scope of this invention thereto unless particularly described. Also, the materials, shapes, etc. of members once described in the following description are similar to those described at first unless particularly newly described. Unless particularly explained in the following description, the "longitudinal direction" refers to the axial direction of a developing roller.

First Embodiment

Figure 1:
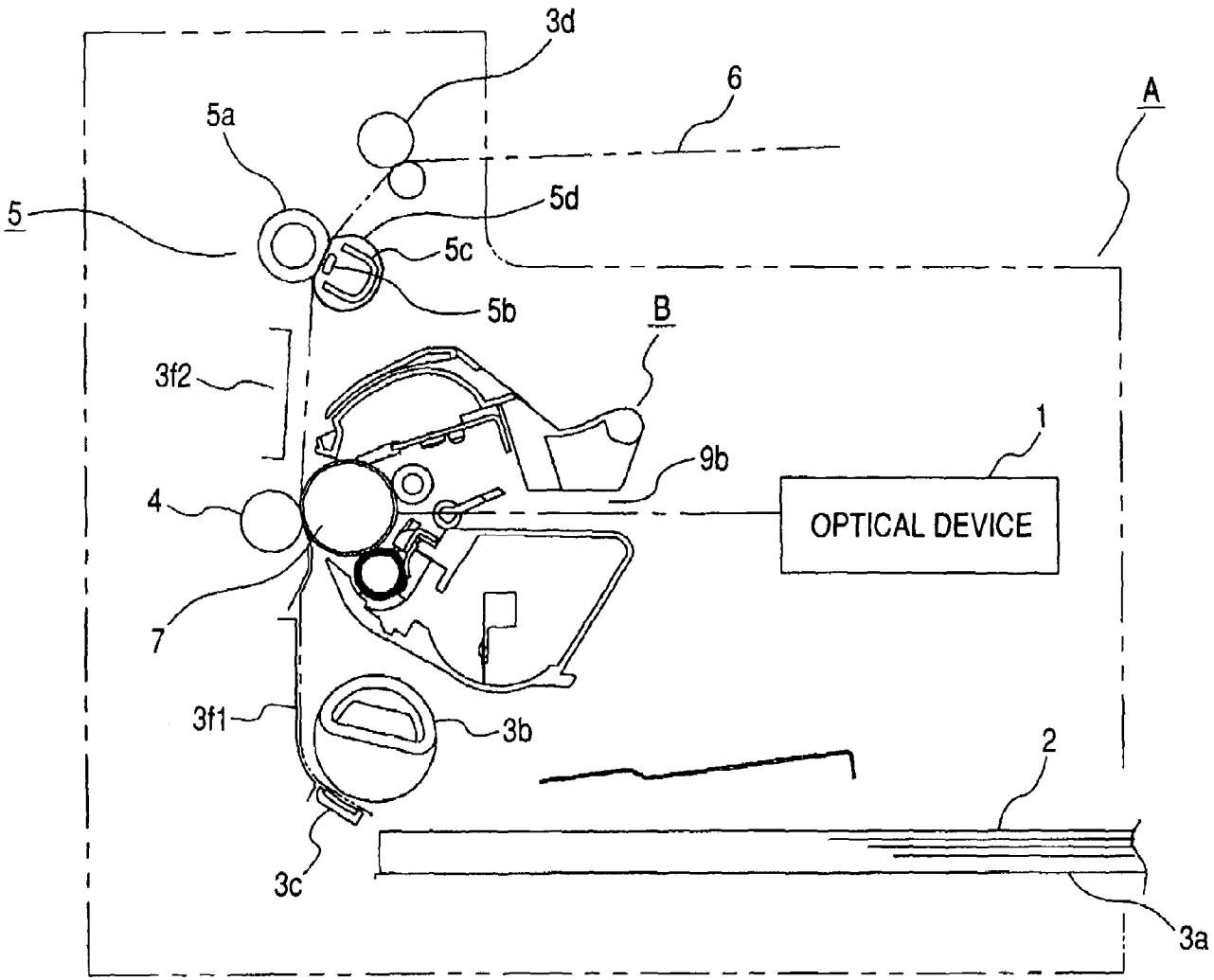
FIG. 1 is a cross-sectional view showing the construction of an electrophotographic image forming apparatus on which a process cartridge according to an embodiment of the present invention is mounted.
Figure 2:
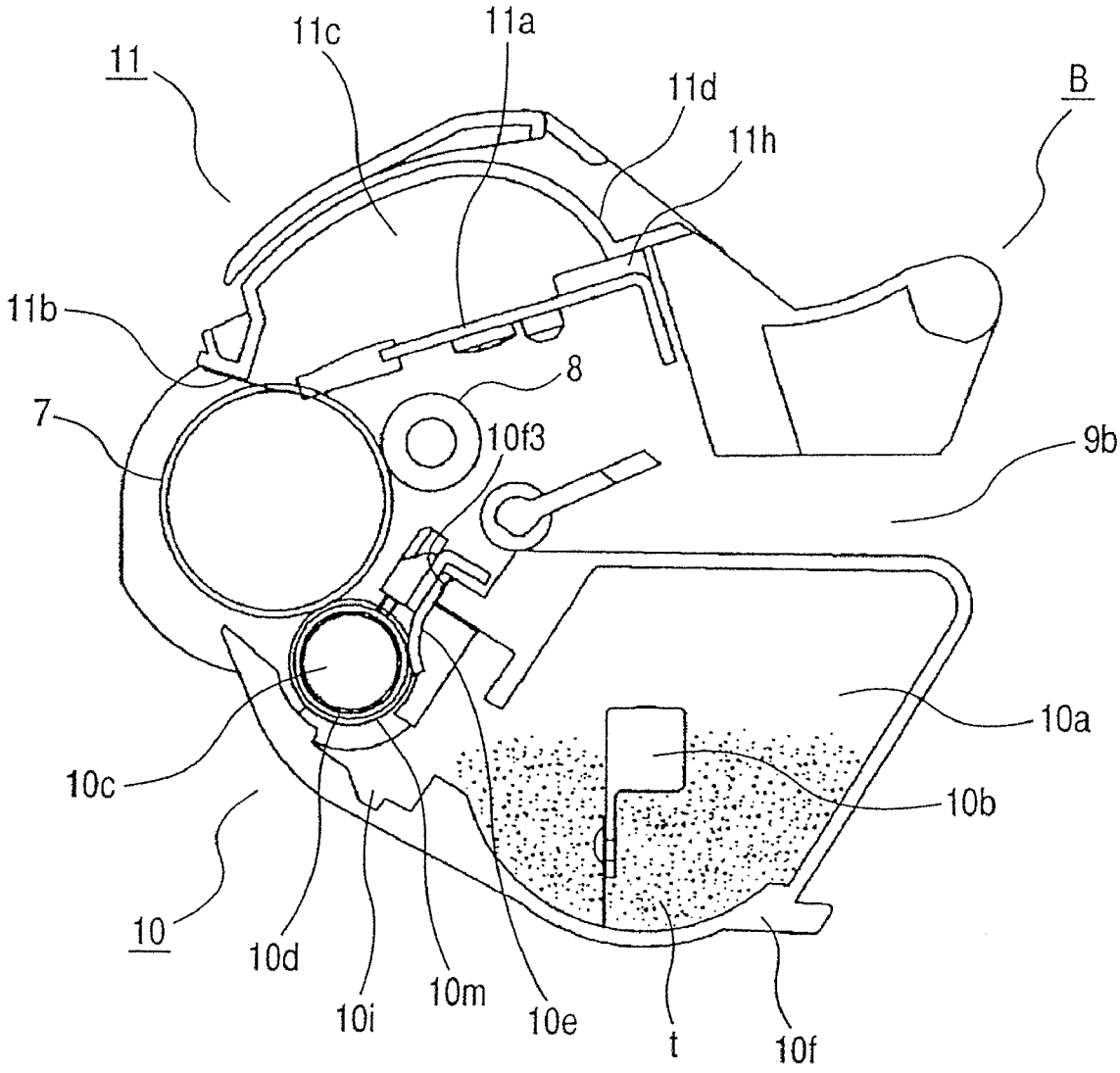
FIG. 2 is a cross-sectional view showing the construction of the process cartridge according to the embodiment.

Reference is first had to FIGS. 1 and 2 to describe a process cartridge and an electrophotographic image forming apparatus to which it is detachably mountable. FIG. 1 is a cross-sectional view showing the construction of an electrophotographic image forming apparatus on which a process cartridge according to the present embodiment is mounted. FIG. 2 is a cross-sectional view showing the construction of a process cartridge according to the present embodiment.

(Electrophotographic Image Forming Apparatus)

As shown in FIG. 1, the electrophotographic image forming apparatus (a laser beam printer, hereinafter referred to as the "image forming apparatus") A applies light based on image information from an optical device 1 to a drum-shaped electrophotographic photosensitive member (hereinafter referred to as the "photosensitive drum") 7. Thereby, an electrostatic latent image is formed on the photosensitive drum 7. Then, this electrostatic latent image is developed with a developer "t" (toner), whereby a developer image (toner image) is formed on the photosensitive drum 7.

Also, in synchronism with the forming of the developer image, recording media (such as recording paper, OHP sheets or cloth) 2 are separated and fed one by one from a cassette 3*a* by a pickup roller and a pressure contact member 3*c* which is in pressure contact therewith. The recording medium 2 fed out from the cassette 3*a* in conveyed to the area between a transfer roller 4 as transferring means and the photosensitive drum 7 along a conveying guide 3*f*1. The developer image formed on the photosensitive drum 7 is transferred to the recording medium 2 by the transfer roller 4 to which a voltage has been applied. Then, the recording medium 2 is conveyed to fixing means 5 along a conveying guide 3*f*2.

The fixing means 5 has a driving roller 5*a* and a fixing rotary member 5*d* comprised of a cylindrical sheet. The fixing rotary member 5*d* has a heater 5*b* therein, and is rotatably supported by a supporting member 5*c*. Heat and pressure are applied to the recording medium 2 by the fixing means 5. As a result, the toner image is fixed on the recording medium 2. Then, this recording medium 2 is conveyed by discharging rollers 3*d* and is discharged to a discharging portion 6. In the present embodiment, conveying means is constituted by the pickup roller 3*b*, the pressure contact member 3*c* and the discharging rollers 3*d*.

Figure 3:
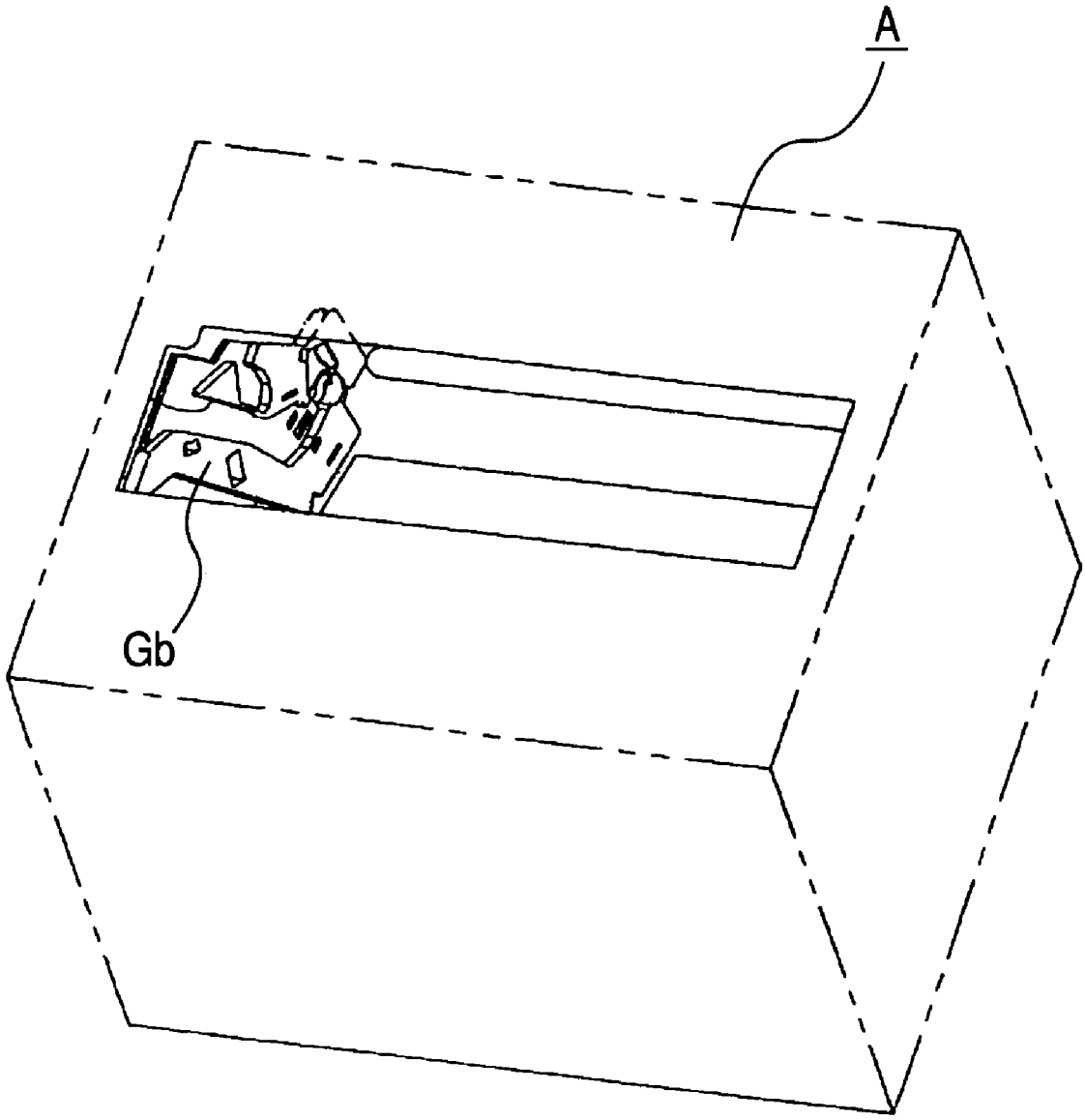
FIG. 3 is a perspective view showing the guide member of an electrophotographic image forming apparatus according to an embodiment of the present invention.
Figure 4:
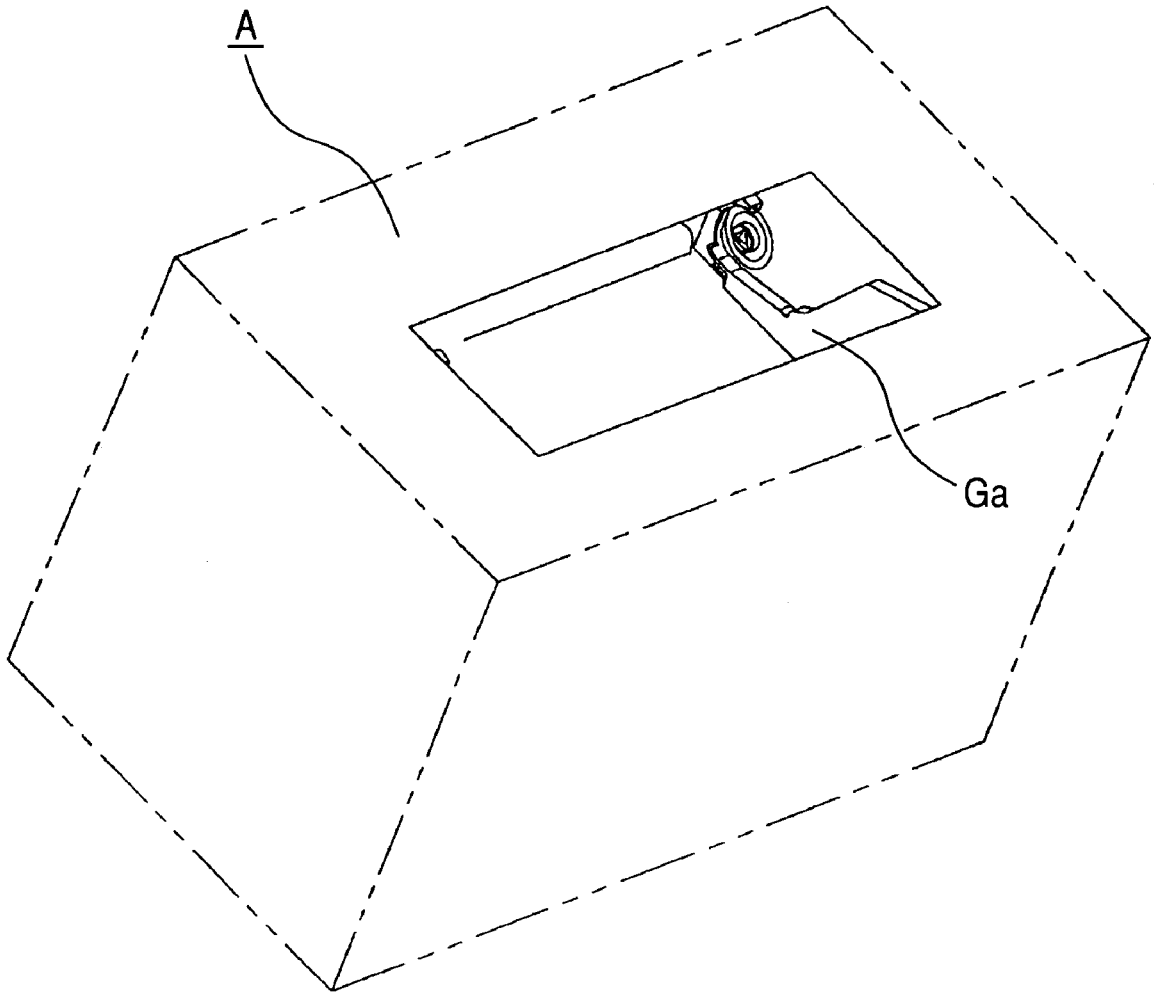
FIG. 4 is a perspective view showing the guide member of the electrophotographic image forming apparatus according to the embodiment.

Also, as shown in FIGS. 3 and 4, the image forming apparatus A has guide members Ga and Gb (detachably mounting means) for guiding a process cartridge B, which will be described later, to a predetermined position. These guide members Ga and Gb are for making the cartridge B detachably mountable to the image forming apparatus A.

(Process Cartridge)

The process cartridge B is provided with the photosensitive drum 7 and at least one process means. As the process means, there are, for example, charging means for charging the photosensitive drum 7, developing means for developing the electrostatic latent image formed on the photosensitive drum 7, cleaning means for removing the developer "t" residual on the photosensitive drum 7, etc.

As shown in FIG. 2, the cartridge B has the rotatable photosensitive drum 7 and a charging roller 8 which is charging means for uniformly charging the surface of the photosensitive drum 7. The cartridge B further has an exposure opening 9*b* for passing therethrough light L for exposing the charged photosensitive drum 7. The light L is emitted from the optical device 1. The photosensitive drum 7 is exposed to this light L, whereby an electrostatic latent image is formed on the photosensitive drum 7. The cartridge B has a developing apparatus 10 for developing the electrostatic latent image, and cleaning means 11 for removing the developer "t" residual on the photosensitive drum 7.

(Developing Apparatus)

The developing apparatus 10 according to the present embodiment has a developing frame member 10*f*, a developing roller 10*d*, a developing blade (layer thickness regulating member) 10*e*, magnetic seals (seal members) 10*r* and end portion regulating members 10*t* as regulating members. The developing frame member 10*f* contains therein the developer "t" having magnetic powder. The developing roller 10*d* is rotatably supported by the developing frame member 10*f*, and carries the developer "t" thereon. Further, a stationary magnet (magnet member) 10*c* is provided in the interior of the developing roller 10*d*. Also, the developing blade 10*e* forms a layer of developer "t" having a predetermined thickness on the surface of the developing roller 10*d*. Also, the magnetic seals 10*r* are provided on the longitudinally opposite end portions of the developing roller 10*d* in opposed relationship with the surface of the developing roller 10*d*. Also, the end portion regulating member 10*t* has a regulating portion 10*t*2 for regulating the layer thickness of the developer "t" passed through the interstice between the developing blade 10*e* and the magnetic seal 10*r*. Also, a feeding member 10*b* feeds out the developer "t" in a developer containing portion 10*a* toward a developing chamber 10*i* by the rotation thereof.

The developing roller 10*d* is rotated. Together therewith, a layer of developer "t" given triboelectric charges by the developing blade 10*e* is formed on the surface of the developing roller 10*d*. Then, the developer "t" shifts to the photosensitive drum 7 in accordance with the electrostatic latent image. Thereby, a developer image is formed on the surface of the photosensitive drum 7.

The developer image formed on the surface of the photosensitive drum 7 is transferred to the recording medium 2 by a voltage opposite in polarity to the developer image being applied to the transfer roller 4. On the other hand, the residual developer "t" on the photosensitive drum 7 is scraped off by a cleaning blade 11*a* as the cleaning means 11. Then, the developer "t" scraped off from the photosensitive drum 7 is scooped by a scooping sheet 11*b*. Then, the scooped developer "t" is collected into a removed toner containing portion 11*c*.

The developing frame member 10*f* is supported for pivotal movement relative to a cleaning frame member 11*d* so that the developing roller 10*d* may be opposed to the photosensitive drum 7 in parallel thereto with a predetermined interval kept therebetween. Spacers 10*m* (see FIG. 6) for keeping the interval between the developing roller 10*d* and the photosensitive drum 7 are disposed on the opposite end portions of the developing roller 10*d*.

Figure 5:
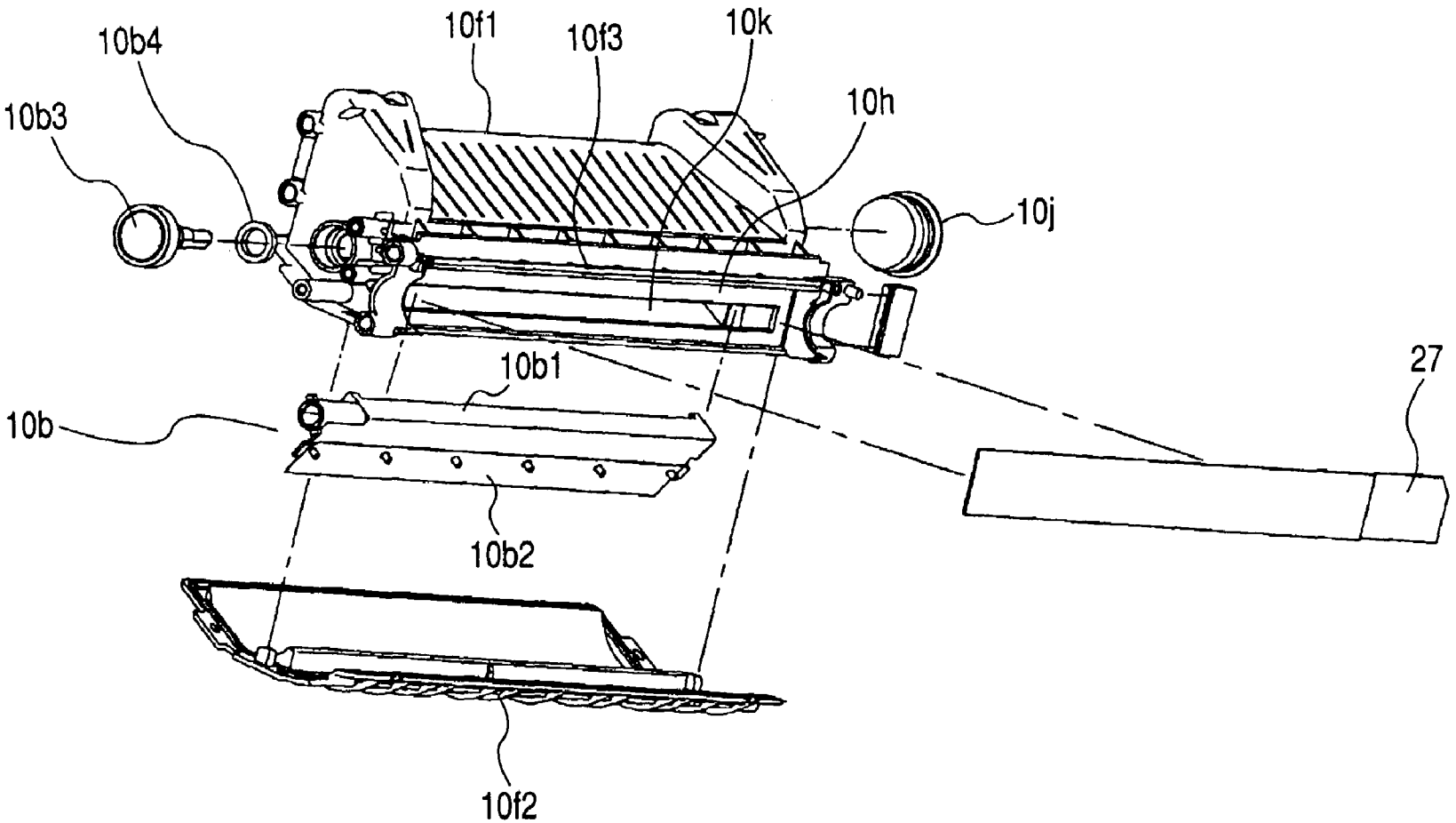
FIG. 5 is an exploded perspective view showing the step of assembling a developing apparatus.
Figure 6:
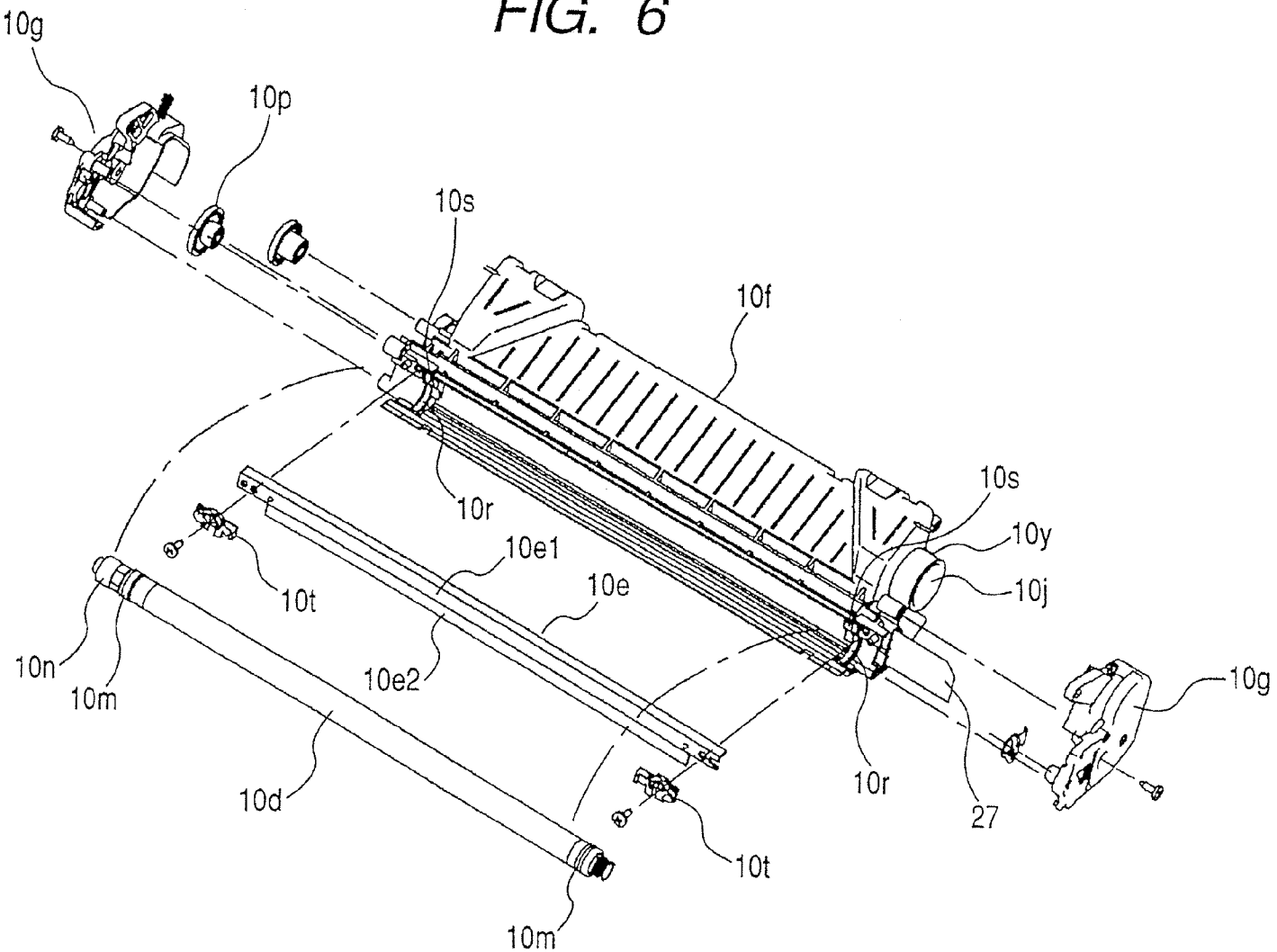
FIG. 6 is an exploded perspective view showing the step of assembling the developing apparatus.

As shown in FIGS. 2, 5 and 6, the developing frame member 10*f* comprises a first frame member 10*f*1 and a second frame member 10*f*2 coupled together. The developing frame member 10*f* is provided with a developer containing portion 10*a* for containing the developer "t" therein, and a developing chamber 10*i* for supporting the developing roller 10*d*.

An agitating shaft 10*b*1 for agitating the developer "t" in the developer containing portion 10*a* is supported on the first frame member 10*f*1. A sheet member 10*b*2 is fixed to the agitating shaft 10*b*1. In order to receive the transmission of a driving force, a carrying gear 10*b*3 is fixed to the agitating shaft 10*b*1. The carrying gear 10*b*3 regulates the longitudinal position of the agitating shaft 10*b*1. In order to prevent the developer "t" from leaking from the developer containing portion 10*a*, a containing portion sealing member 10*b*4, together with the carrying gear 10*b*3, is mounted on the outside of the first frame member 10*f*1.

Also, the first frame member 10*f*1 is formed with a passage opening 10*k*. The developer "t" contained in the developer containing portion 10*a* passes through this passage opening 10*k* when it is supplied to the developing roller 10*d*.

As shown in FIG. 5, a toner seal member 27 is fixed to a seal attaching portion 10*h* provided along the four side edges of the passage opening 10*k*.

Also, a developer filling port 10*y* for filling the developer containing portion 10*a* with the developer "t" is provided in one end of the first frame member 10*f*1 in the longitudinal direction thereof. This filling port 10*y* is sealed by a tap member 10*j* after the developer containing portion has been filled with the developer "t".

Reference is now had to FIG. 6 to describe the step of incorporating the developing blade 10*e* and the developing roller 10*d* into the developing frame member 10*f*.

The first frame member 10*f*1 has magnetic seals 10*r* as seal members attached thereto. The magnetic seals 10*r* prevent the developer "t" from leaking out from the opposite end portions of the developing roller 10*d*. Also, leakage preventing members 10*s* are stuck on the first frame member 10*f*1 by a two-sided tape or the like. These leakage preventing members 10*s* prevent the developer "t" from leaking outwardly from the opposite ends of the developing blade 10*e*.

The developing blade 10*e* has a rubber portion 10*e*2 and a metal plate portion 10*e*1. The metal plate portion 10*e*1 supports the rubber portion 10*e*2. The opposite ends of the metal plate portion 10*e*1, together with end portion regulating members 10*t*, is fixed to the first frame member 10*f*1 by screws. The end portion regulating members lot make the thickness of the developer layer on the end portions of the developing roller 10*d* small and level it. A rib 10*f*3 formed by the distal end of the first frame member 10*f*1 becoming thin is set to such dimensions that it eats into the rubber portion 10*e*2. Accordingly, the space between the rubber portion 10*e*2 and the first frame member 10*f*1 is sealed by the rib 10*f*3.

Also, a drum gear (not shown) is fixed to an end portion of the photosensitive drum 7. Also, a developing roller gear 10*n* is fixed to an end portion of the developing roller 10*d*. The drum gear and the developing roller gear 10*n* are in meshing engagement with each other. Further, a gear train having two idler gears 10*p* and 10*g* is constructed. The gear train transmits drive from the developing roller gear 10*n* to the carrying gear 10*b*3 of a developer feeding member 10*b*. One of end portion members 10*g* disposed on the longitudinally opposite sides of the developing apparatus 10 covers the drum gear, the developing roller gear 10*n* and the gear train.

Figure 7:
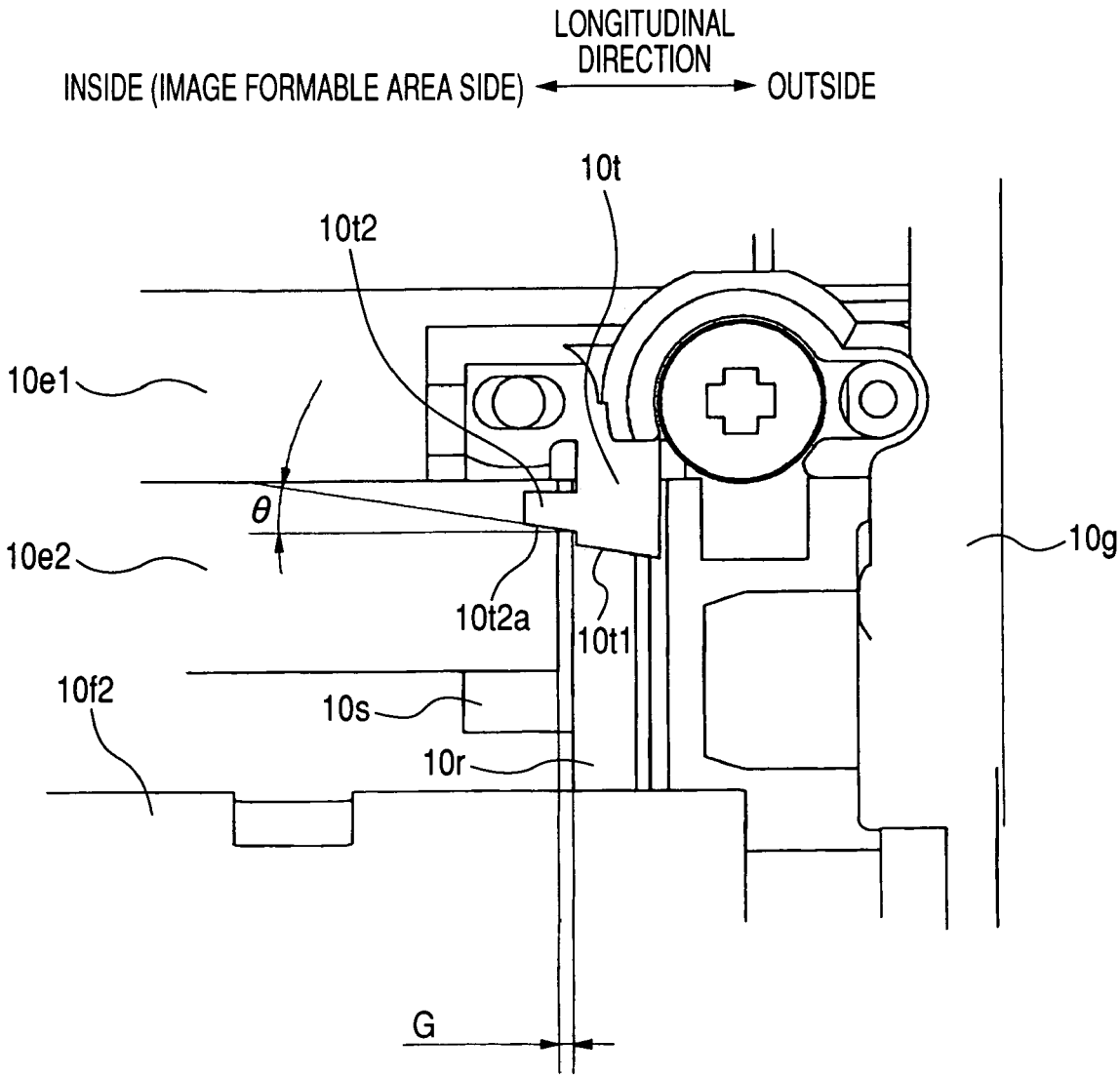
FIG. 7 is a front view of the vicinity of the seal member of a developing apparatus according to an embodiment of the present invention.
Figure 8:
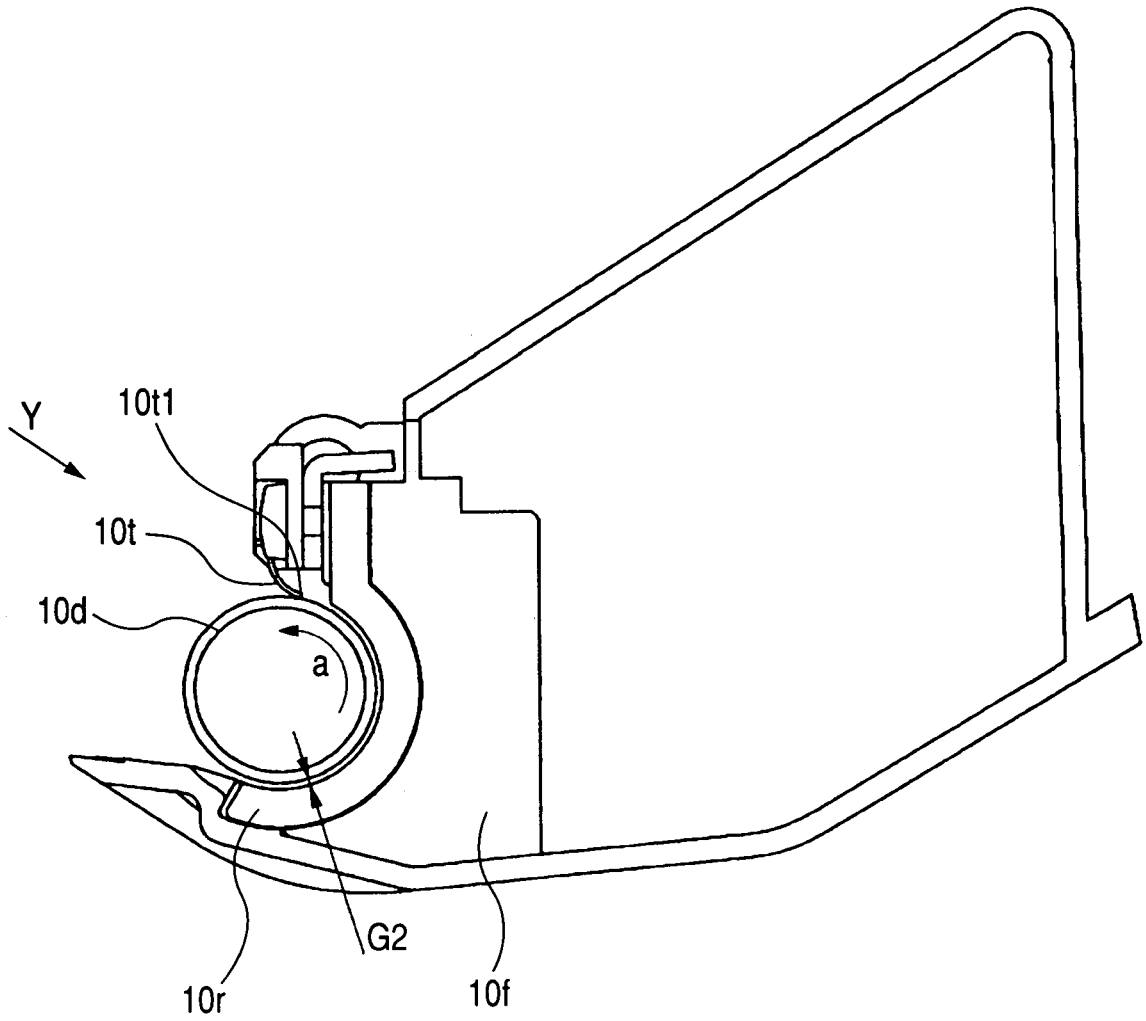
FIG. 8 is a cross-sectional view of a developing apparatus according to a first embodiment of the present invention.
Figure 9B:
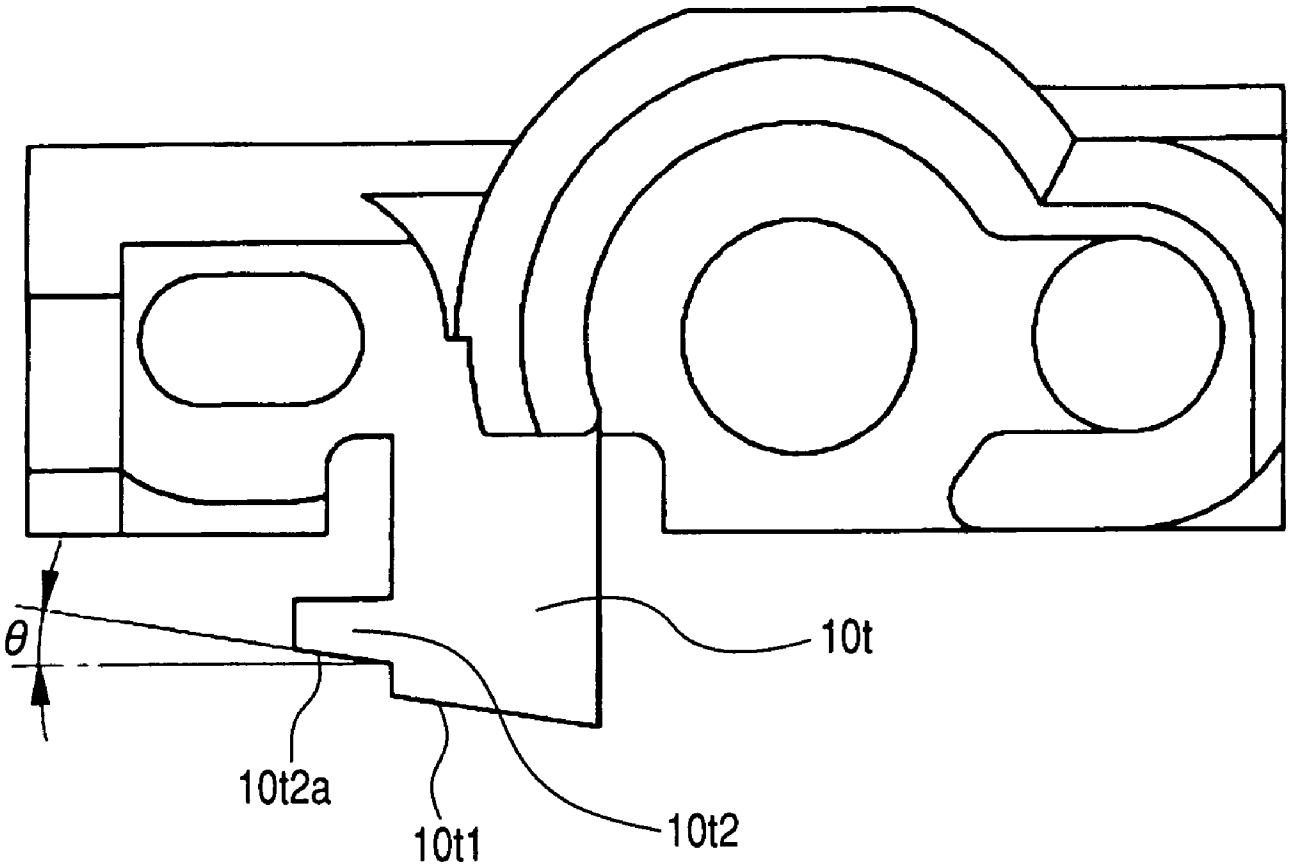
FIG. 9B is a front view of the end portion regulating member.
Figure 9A:
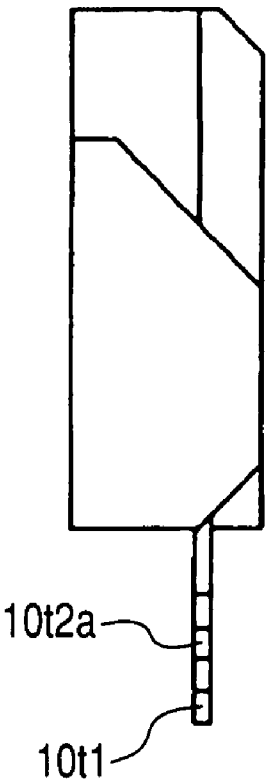
FIG. 9A is a side view of an end portion regulating member according to the first embodiment.

Reference is now had to FIGS. 7, 8, 9A and 9B to describe the construction of the vicinity of the seal member according to the present invention. FIG. 7 is a front view of the vicinity of the seal member of the developing apparatus according to the present embodiment. FIG. 8 is a cross-sectional view of the developing apparatus according to the present embodiment. FIG. 9A is a side view of the end portion regulating member 10*t* according to the present embodiment, and FIG. 9B is a front view of the end portion regulating member 10*t*.

In order to prevent the developer "t" from leaking out of the developing chamber 10*i*, the magnetic seals 10*r* are provided on the outside of the developing blade 10*e* in the longitudinal direction thereof. The magnetic seals 10*r* are provided in non-contact with the developing roller 10*d* in opposed relationship with the surface of the developing roller 10*d*. The magnetic seals 10*r* are ferromagnetic members (of the order of 2000G on the surfaces thereof).

By the magnetic force of the magnetic seals 10*r*, the developer "t" is held in the interstice portions G2 between the magnetic seals 10*r* and the developing roller 10*d*. Thereby, the developer "t" is prevented from leaking out of the cartridge B through these interstice portions G2.

Also, the developing apparatus 10 is provided with the end portion regulating members lot. The end portion regulating members 10*t* return the developer "t" passed through the interstice portions G2 by the rotation of the developing roller 10*d* again to the image formable area (the area longitudinally inward of the magnetic seals 10*r*).

The end portion regulating members 10*t* are provided downstream of the magnetic seals 10*r* and the developing blade 10*e* with respect to the rotating direction (the direction indicated by the arrow "a") of the developing roller 10*d*. Also, a portion of each end portion regulating member 10*t* is in contact with the developing roller 10*d*. That is, as shown in FIG. 7, the end portion regulating members 10*t* overlap the respective magnetic seals 10*r* in the longitudinal direction. Further, in the longitudinal direction, the end portion regulating members 10*t* extend to the outer sides of the magnetic seals 10*r*.

The end portion regulating members 10*t* have scraping portions 10*t*1. The scraping portions 10*t*1 scrape off the developer "t" passed through the interstice portions G2 by the rotation of the developing roller 10*d* from the surface of the developing roller 10*d* before it arrives at the developing portion between the developing roller 10*d* and the photosensitive drum 7.

Also, in the present embodiment, an interstice G is formed between the rubber portion 10*e*2 and each magnetic seal 10*r*. Owing to this construction, it never happens even when the developing roller 10*d*, the magnetic seals 10*r* and the developing blade 10*e* are assembled to the developing frame member 10*f* that the rubber portion 10*e*2 is sandwiched between the developing roller 10*d* and the magnetic seals 10*r*. As a result, the pressure of the rubber portion 10*e*2 against the developing roller 10*d* can be prevented from becoming strong in the longitudinal end portions. Also, the interstice portion G between the developing roller 10*d* and each magnetic seal 10*r* can be stabilized.

The scraping portions 10*t*1 are provided at locations at which at least a portion thereof overlaps the magnetic seals 10*r* in the longitudinal direction of the developing roller 10*d*. Further, the scraping portions 10*t*1 are in contact with the developing roller 10*d*. Thereby, even if the developer "t" leaks from the magnetic seals 10*r*, the scraping portions 10*t*1 can return the developer "t" to the image formable area. Also, the scraping portions 10*t*1 are of such a shape that with the developing roller 10*d* mounted on the developing frame member 10*f*, the contact positions thereof with the surface of the developing roller 10*d* lie on the downstream side with respect to the rotating direction of the developing roller 10*d* from the outside toward the inside of the developing roller 10*d* in the longitudinal direction thereof.

Therefore, the developer "t" scraped off by the scraping portions 10*t*1 receives a force toward the inside (the image formable area side) of the developing roller 10*d* in the longitudinal direction thereof while being carried by the rotation of the developing roller 10*d*. Thus, the scraped developer "t" is gradually moved to the image formable area side. As a result, the scraped developer "t" can be prevented from leaking out to the outside of the developing roller 10*d* in the longitudinal direction thereof.

As shown in FIGS. 7 and 9B, the distal end of the scraping portion 10*t*1 is obliquely cut with respect to the longitudinal direction with the developing roller 10*d* not assembled to the developing frame member 10*f*. Further, in the longitudinal direction, the outside of the scraping portion 10*t*1 is longer than the inside thereof. As a result, when the developing roller 10*d* is to be mounted on the developing frame member 10*f*, the outside of the distal end portion of the scraping portion 10*f*1 first contacts with the developing roller 10*d* and is deformed. Further, as the developing roller 10*d* is mounted on the developing frame member 10*f*, the distal end portion of the scraping portion 10*t*1 is deformed so as to twist from the outside toward the inside. As a result, the location at which the scraping portion 10*t*1 contacts with the developing roller 10*d* is on the downstream side with respect to the rotating direction of the developing roller 10*d* from the outside toward the inside of the developing roller 10*d* in the longitudinal direction thereof.

In the present embodiment, the scraping portion 10*t*1 is a thin plastic piece. The scraping portion 10*t*1 is flexed and is in contact with the peripheral surface of the developing roller 10*d*. As another example, the abutting portion of the scraping portion 10*t*1 against the developing roller 10*d* may be made into an arcuate shape conforming to the peripheral surface of the developing roller 10*d*.

A description will now be provided of the regulating portions of the end portion regulating members.

With the end portion regulating member 10*t* assembled to the developing frame member 10*f*, at least a portion of the regulating portion 10*t* is provided at a location whereat it overlaps the interstice G between the magnetic seal 10*r* and the developing blade 10*e* (see FIG. 7). By doing so, the amount of the developer "t" passing through the interstice G can be regulated. Also, the regulating portion 10*t*2 is on the inside of the scraping portion 10*t*1 in the longitudinal direction. Also, the regulating portion 10*t*2 is coupled to the scraping portion 10*t*1. That is, the regulating portion 10*t*2 is provided so as to protrude from the scraping portion 10*t*1 toward the inside in the longitudinal direction. The regulating portion 10*t*2 regulates the layer thickness of the developer "t" and has a gap with respect to the peripheral surface of the developing roller 10*d*. Therefore, by the scraping portion 10*t*1 being positioned, the positioning of the regulating portion 10*f*2 can be made. Accordingly, the work of mounting the end portion regulating members 10*t* on the developing frame member 10*f* becomes easy.

Figure 10:
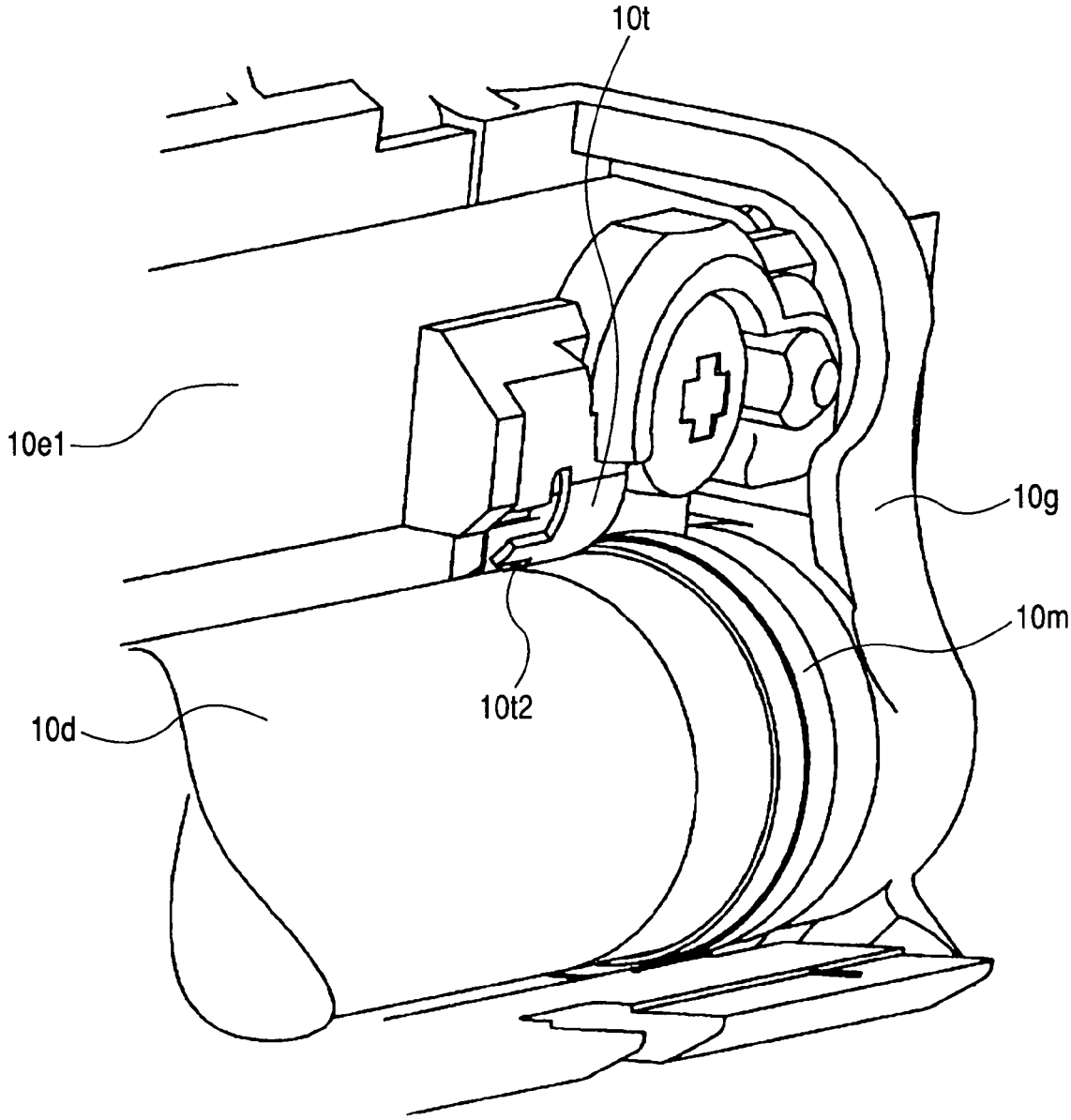
FIG. 10 is a fragmentary perspective view of the developing apparatus in a state in which the end portion regulating member according to the first embodiment and a developing roller are mounted on a developing frame member.
Figure 11:
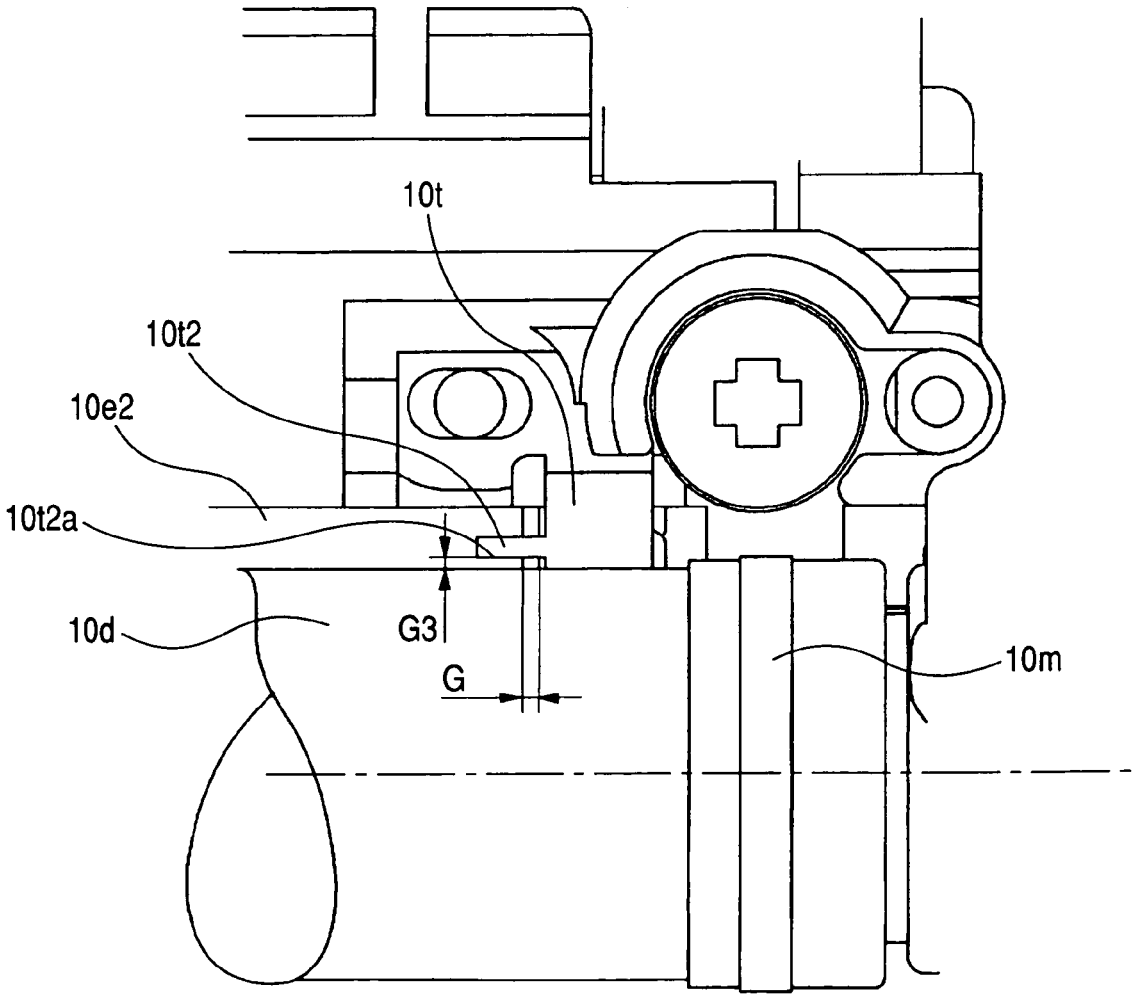
FIG. 11 is a fragmentary front view of the developing apparatus in the state in which the end portion regulating member according to the first embodiment and the developing roller are mounted on the developing frame member as it is seen from Y direction in FIG. 8.

FIG. 10 is a fragmentary perspective view of the developing apparatus showing a state in which the end portion regulating members according to the present embodiment and the developing roller are mounted on the developing frame member. FIG. 11 is a fragmentary perspective view of the developing apparatus as it is seen from Y direction in FIG. 8 with the end portion regulating members according to the present embodiment and the developing roller mounted on the developing frame member.

As shown in FIGS. 10 and 11, in its assembled state, the regulating portion 10*t*1 has,a predetermined gap with respect to the developing roller 10*d*. At this time, the scraping portion 10*t*1 is twisted and is in contact with the developing roller 10*d*. As shown in FIGS. 7 and 9B, that side 10*t*2*a* of the regulating portion 10*t*2 which is opposed to the developing roller 10*d* is oblique so as to assume an angle θ with respect to the longitudinal direction. Therefore, a uniform gap G3 is formed between the regulating portion 10*t*2 and the developing roller 10*d*. Therefore, when the layer thickness of the developer "t" passed through the interstice G becomes a layer thickness equal to or greater than G3, the layer thickness can be regulated. Also, when the layer thickness of the developer "t" passed through the interstice G is a layer thickness less than G3, the passage of the developer "t" is permitted. Thereby, it is possible to regulate the layer thickness of the developer "t" to G3 or less without giving any excess load to the developer "t".

Accordingly, by providing the above-described regulating portion 10*t*2, if the layer thickness is not regulated by the developing blade 10*e* but the developer layer carried from the interstice G has a layer thickness equal to or greater than G, the layer thickness can be made smaller. Thus, the developer "t" can be prevented from unnecessarily adhering to the photosensitive drum 7. As a result, the fogging of and the carrier adherence or the like to the end portions of an image formed on the recording medium can be prevented. Accordingly, a good image can be formed.

Second Embodiment

Figure 12:
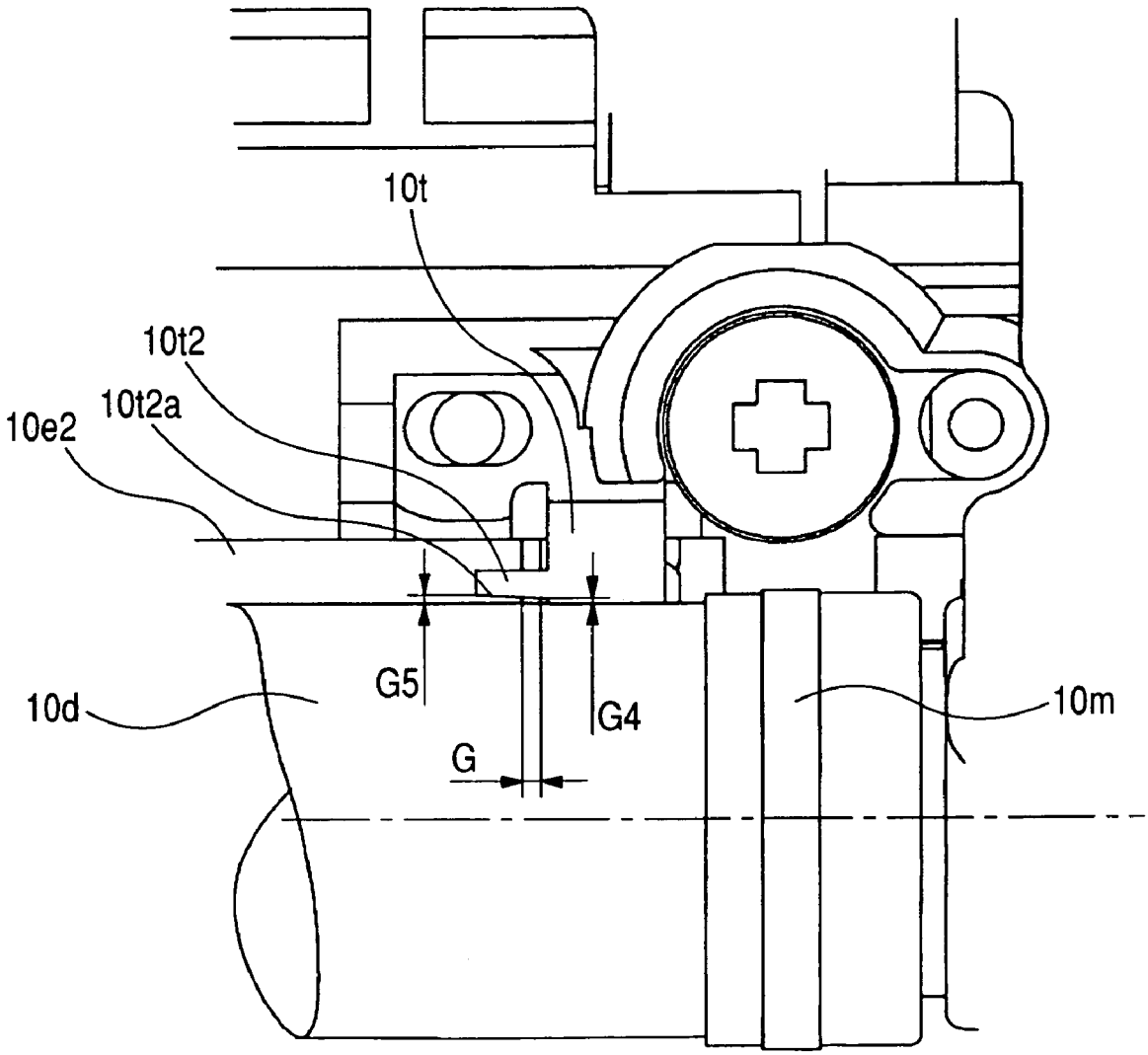
FIG. 12 is a fragmentary front view of the developing apparatus in a state in which an end portion regulating member according to a second embodiment of the present invention and the developing roller are mounted on the developing frame member as it is seen from Y direction in FIG. 8.
Figure 13B:
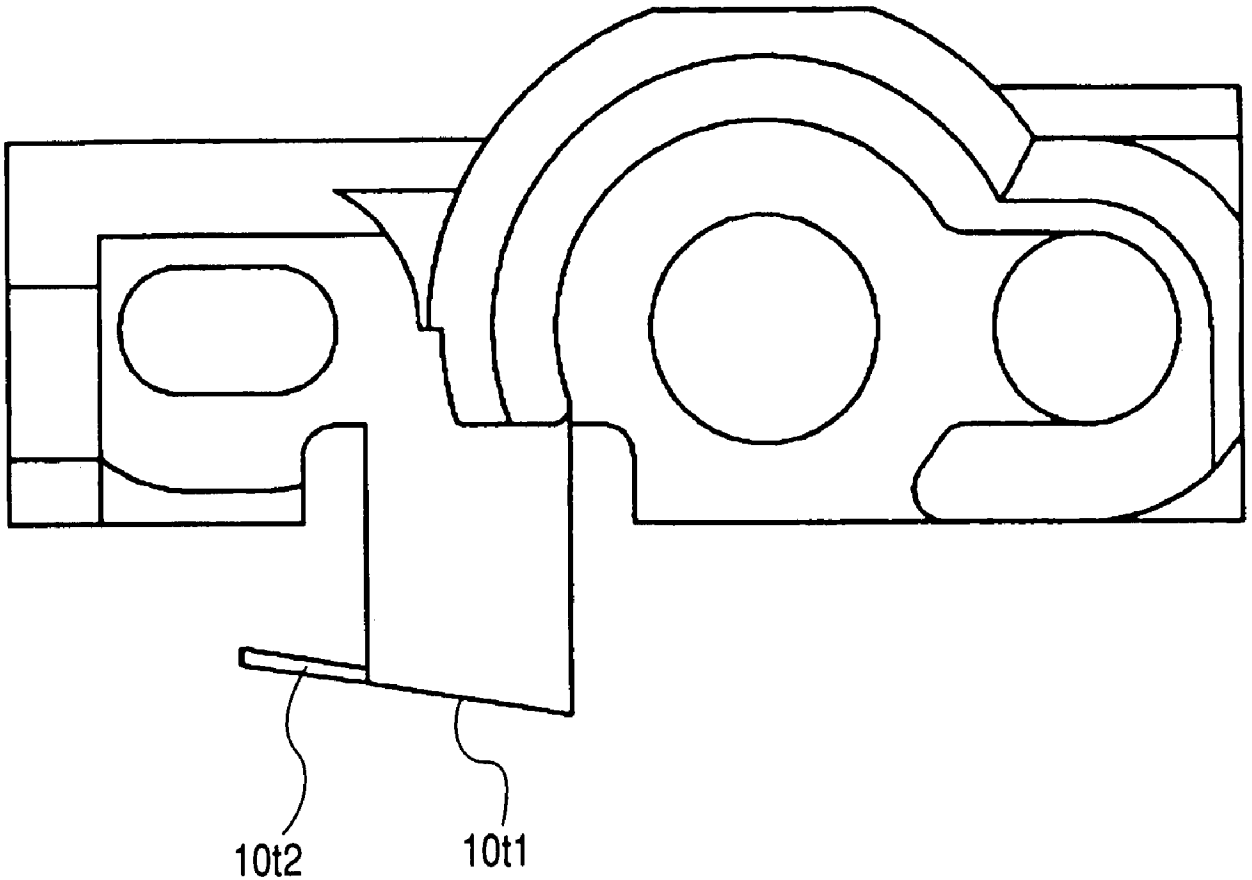
FIG. 13B is a front view of the end portion regulating member.
Figure 13A:
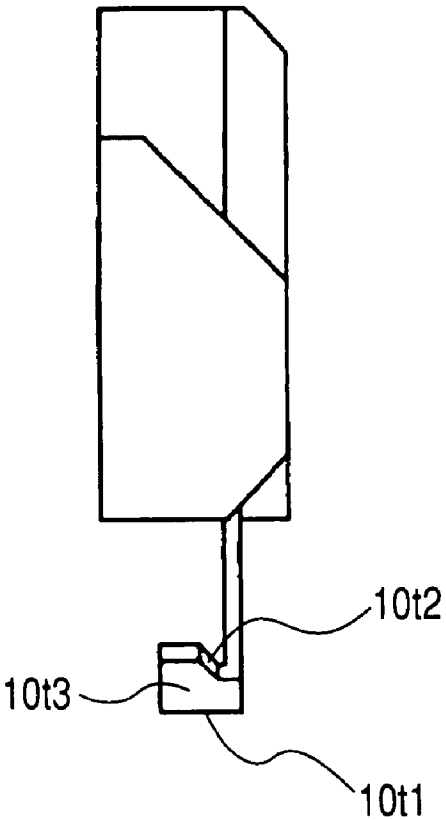
FIG. 13A is a side view of the end portion regulating member according to the second embodiment.
Figure 14:
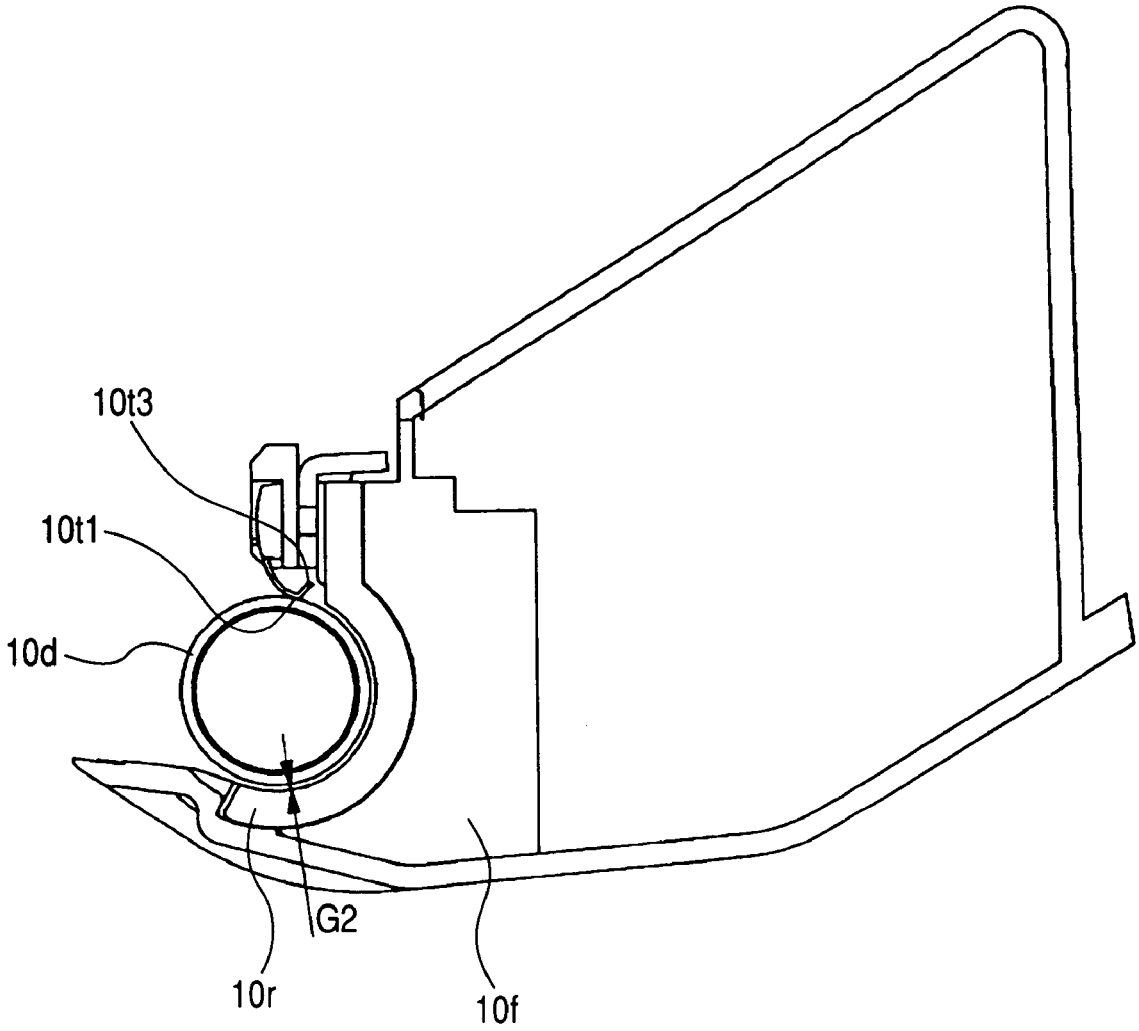
FIG. 14 is a cross-sectional view of a developing apparatus according to the second embodiment.
Figure 15:
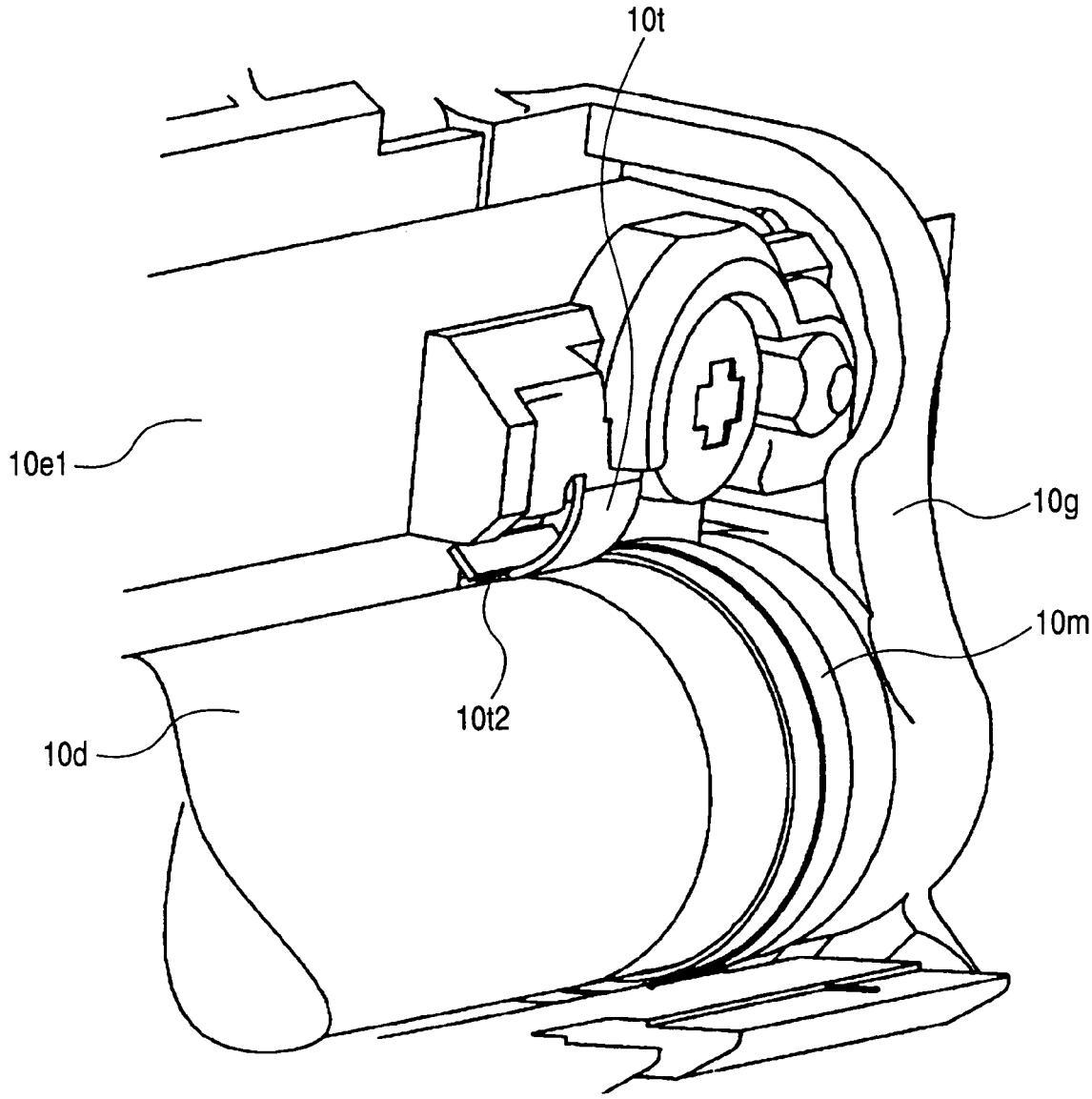
FIG. 15 is a fragmentary perspective view of the developing apparatus in a state in which the end portion regulating member according to the second embodiment and the developing roller are mounted on the developing frame member.

FIG. 12 is a fragmentary front view of the developing apparatus as it is seen from Y direction in FIG. 8 with end portion regulating members according to a second embodiment and the developing roller mounted on the developing frame member. FIG. 13A is a side view of the end portion regulating member according to the second embodiment, and FIG. 13B is a front view of the end portion regulating member. FIG. 14 is a cross-sectional view of a developing apparatus according to the second embodiment. FIG. 15 is a fragmentary perspective view of the developing apparatus in a state in which the end portion regulating portions according to the second embodiment and the developing roller are mounted on the developing frame member.

The regulating portion 10*t*2 according to the present embodiment is of such a shape that in the longitudinal direction of the developing roller 10*d*, the distance thereof from the developing roller 10*d* becomes greater from the outside toward the inside (see FIG. 12). That is, a gap G5 at the distal end of the regulating portion 10*t*2 is greater than a gap G4 near the coupled portion between the regulating portion 10*t*2 and the scraping portion 10*t*1.

Accordingly, the distance between the regulating portion 10*t*2 and the developing roller 10*d* gradually becomes greater, whereby even if the developer "t" scraped and gathered by the scraping portion 10*t*1 is greater in amount, the developer "t" can be prevented from locally gathering. That is, the layer thickness of the developer "t" can be leveled. Accordingly, the developer "t" can be prevented from unnecessarily adhering to the photosensitive drum 7. As a result, faulty images can be reduced. Consequently, good images can be obtained.

Also, the end portion regulating member 10*t* according to the present embodiment is of a shape in which the scraping portion 10*t*1 is bent. A damming-up portion 10*t*3 for preventing the developer "t" from accumulating is provided on a side opposite to a surface on which the scraping portion 10*t*1 contacts with the developing roller 10*d*. The damming-up portion 10*t*3 is extended to the regulating portion 10*t*2.

As a result, in a state in which the end portion regulating members 10*t* and the developing roller 10*d* have been incorporated into the developing apparatus 10, the developer "t" scraped off by the scraping portion 10*t*1 does not accumulate on the upper side of the scraping portion 10*t*1. That is, when the damming-up portion 10*t*3 is absent, the developer "t" is liable to accumulate on the scraping portion 10*t*1 (see FIG. 8). However, when the damming-up portion 10*t*3 is present, it is difficult for the developer "t" to accumulate on the scraping portion 10*t*1 (see FIG. 14). Accordingly, the scraped developer "t" does not flow out to the outside in the longitudinal direction of the scraping portion 10*t*1 along the upper side of the scraping portion 10*t*1.

Third Embodiment

Figure 16:
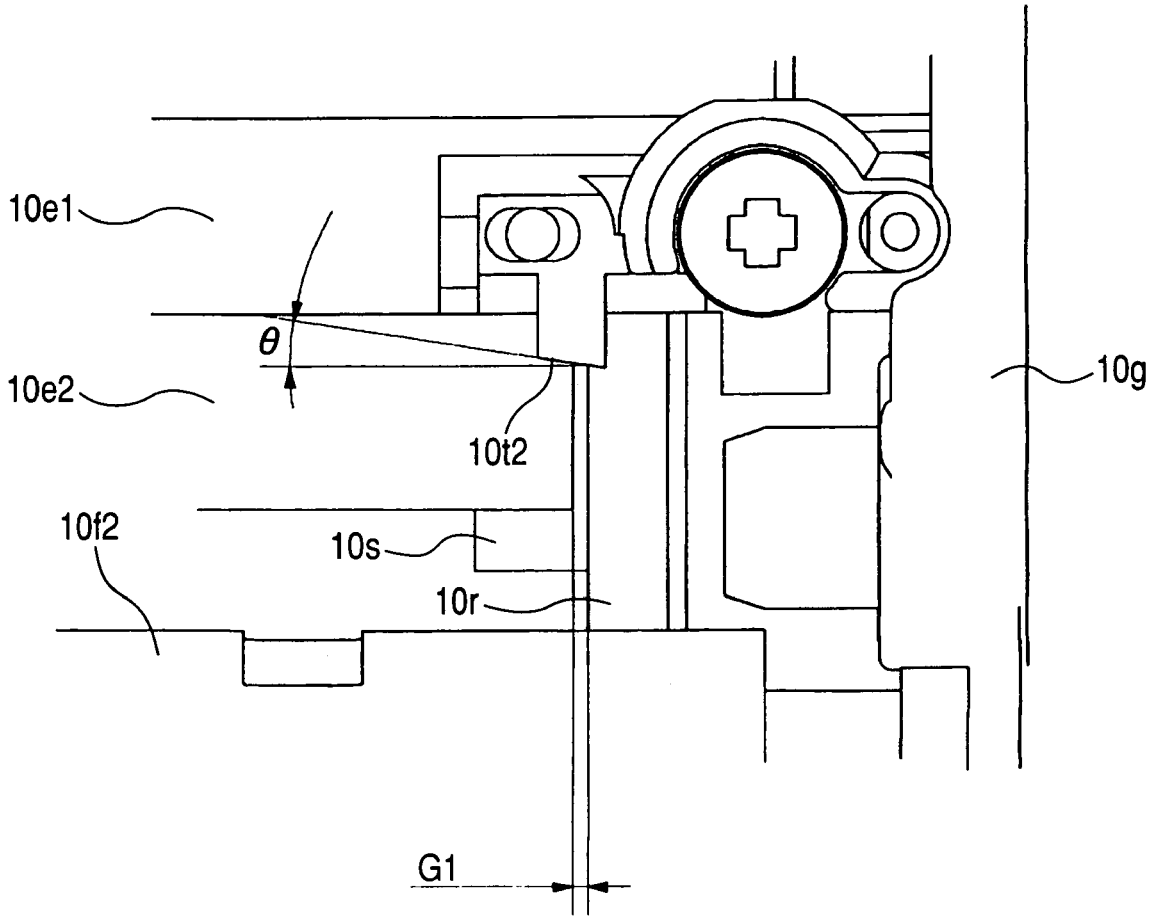
FIG. 16 is a fragmentary front view of a developing apparatus in which an end portion regulating member according to a third embodiment of the present invention and the developing roller are mounted on the developing frame member.
Figure 17:
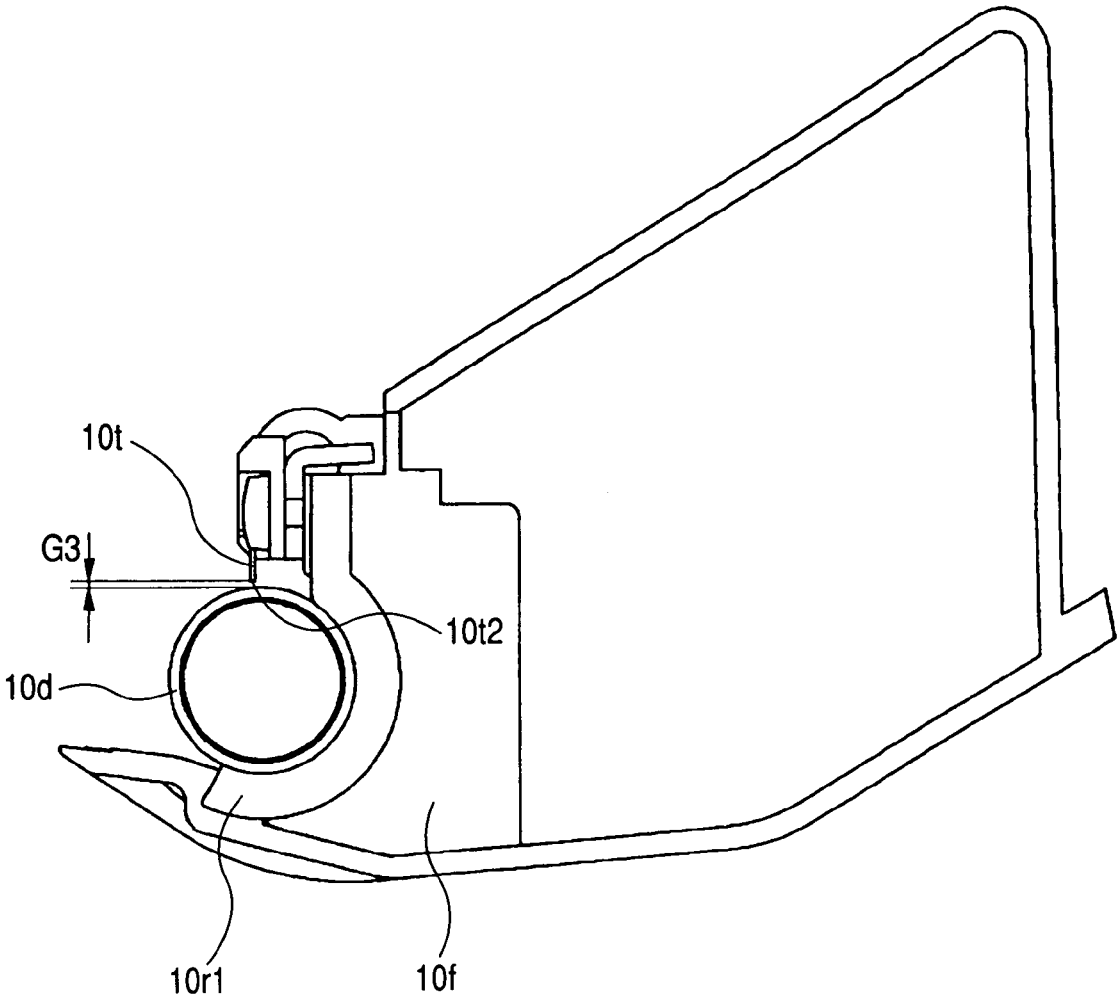
FIG. 17 is a cross-sectional view of a developing apparatus according to the third embodiment.

FIG. 16 is a fragmentary front view of the developing apparatus in a state in which end portion regulating members according to a third embodiment and the developing roller are mounted on the developing frame member. FIG. 17 is a cross-sectional view of a developing apparatus according to the third embodiment.

In the present embodiment, as end portion seal members, elastic seal members 10*r*1 such as felt are brought into contact with the developing roller 10*d*. That is, by the elastic seal members 10*r*1, the developer "t" is prevented from leaking out from the end portions of the developing roller 10*d* to the outside of the cartridge B.

At this time, there may be formed interstices G1 between the rubber portion 10*e*2 of the developing blade and the seal members 10*r*1. Therefore, the regulating portions 10*t*2 are disposed at a distance G3 from the developing roller 10*d* at a location at which they overlap the interstices G1 in the longitudinal direction. As a result, they regulate the layer thickness of the developer "t" passed through the interstices G1 to a predetermined layer thickness. That is, the layer thickness of the developer "t" passed through the interstices G1 can be made small. As a result, the unnecessary adherence of the developer "t" to the photosensitive drum 7 can be prevented. Accordingly, faulty images can be reduced. Here, the magnetic seals 10*r* may be attached instead of the elastic seal members 10*r*1 (not shown). The relation between the respective members in the longitudinal direction is the same as that in the first embodiment and the second embodiment and therefore need not be described.

The process cartridge shown in the above-described embodiments has been shown with respect to a case where a single-color image is formed. The process cartridge according to the present invention, however, can also suitably be applied as a cartridge provided with a plurality of developing apparatuses to thereby form an image of plural colors (e.g. two colors, three colors or full color).

Also, the electrophotographic photosensitive member is not restricted to the photosensitive drum, but may be one of the following members. For example, a photoconductive material is used as the photosensitive member, and as the photoconductive material, there are included, for example, amorphous silicon, amorphous selenium, zinc oxide, titanium oxide and an organic photoconductive material (OPC). Also, as the shape carrying the photosensitive member thereon, use can be made, for example, of a drum shape or a belt shape. Also, in a drum type photosensitive member, a photoconductive material may be vapor-deposited or applied onto a cylinder of an aluminum alloy or the like.

Also, as the developing method, use can be made of one of various methods using a developer having magnetic powder, such as a magnetic one-component developing method using a magnetic toner as the developer, and a two-component magnetic brush developing method using a developer consisting of a magnetic carrier and a toner.

Also, as the cleaning means for the developer residual on the photosensitive drum, use may be made of such cleaning means as a blade, a fur brush or a magnetic brush.

Also, in the aforedescribed embodiments, in the process cartridge detachably mountable to the image forming apparatus, the cleaning blade 11*a* is used to remove the toner residual on the photosensitive drum 7. A similar effect, however, can also be obtained in a cleanerless construction having no cleaning blade.

Also, the electrophotographic image forming apparatus can be any one which forms an image on a recording medium (such as recording paper, an OHP sheet or cloth) by the use of the electrophotographic image forming process. Examples of the electrophotographic image forming apparatus include an electrophotographic copying machine, an electrophotographic printer (such as a laser printer or an LED printer), a facsimile apparatus, a word processor and a compound machine comprising these (such as a multi-function printer).

Also, the process cartridge refers to at least developing means as process means and an electrophotographic photosensitive drum integrally made into a cartridge which is made detachably mountable to the main body of an electrophotographic image forming apparatus. Accordingly, as shown in the aforedescribed embodiments, charging means and cleaning means may be further added as the process means.

The aforedescribed embodiments may be summed up as follows.

A developing apparatus 10 for developing an electrostatic latent image formed on an electrophotographic photosensitive member (photosensitive drum 7), having:

a developing roller 10*d* for carrying thereon a developer "t" having magnetic powder;

a magnetic member (stationary magnet 10*c*) provided in the interior of the developing roller 10*d;* a layer thickness regulating member (developing blade 10*e*) provided along the longitudinal direction of the developing roller 10*d* for regulating the layer thickness of the developer "t" adhering to the surface of the developing roller 10*d;* seal members (magnetic seal 10*r*, elastic seal member 10*r*1) provided outside the layer thickness regulating member (developing blade 10*e*) in the longitudinal direction in opposed relationship with the surface of the developing roller 10*d;* and end portion regulating members 10*t* having regulating portions 10*t*2 for regulating the layer thickness of the developer "t" when the layer thickness of the developer "t" passed through interstices formed between the layer thickness regulating member (developing blade 10*e*) and the seal members (magnetic seal 10*r,* elastic seal member 10*r*1) in the longitudinal direction is equal to or greater than a predetermined layer thickness, and permitting the passage of the developer "t" when the layer thickness of the developer "t" is less than the predetermined layer thickness, the regulating portions 10*t*2 being provided downstream of the layer thickness regulating member (developing blade 10*e*) with respect to the rotating direction of the developing roller 10*d,* and having a gap with respect to the surface of the developing roller 10*d.*

The regulating portions 10*t*2 are such that the gap thereof with respect to the surface of the developing roller 10*d* becomes greater from the outside toward the inside thereof in the longitudinal direction.

The regulating portions 10*t*2 are provided at locations at which at least a portion thereof overlaps the interstices in the longitudinal direction.

Further, the end portion regulating members 10*t* have scraping portions 10*t*1 for scraping off the developer "t" from the developing roller 10*d,* and the scraping portions 10*t*1 are provided outside the regulating portions 10*t*2 with respect to the longitudinal direction.

Further, the scraping portions 10*t*1 are provided at locations at which in the longitudinal direction at least a portion thereof overlaps the seal members (magnetic seal 10*r*, elastic seal member 10*r*1), and are in contact with the developing roller 10*d.*

Further, the scraping portions 10*t*1 are provided in such a manner that from the outside toward the inside in the longitudinal direction, the contact positions thereof with the developing roller 10*d* are inclined toward the downstream side with respect to the rotating direction of the developing roller 10*d.*

Further, the scraping portions 10*t*1 are provided with damming-up portions 10*t*3 for damming up the developer "t" on a side opposite to a surface contacting with the developing roller 10*d,* so that the developer "t" may not accumulate on the opposite side.

According to the present invention, when the developer passed through the interstices between the seal members and the layer thickness regulating member increases more than a predetermined level, the layer thickness thereof can be regulated by the end portion regulating members.

Also, according to the present invention, the amount of the developer unnecessarily adhering to the electrophotographic photosensitive member can be decreased.

While the invention has been described with reference to the structure disclosed herein, it is not confined to the details set forth and the application is intended to cover such modifications or changes as may come within the purpose of the improvements or the scope of the following claims.

This application claims priority from Japanese Patent Application No. 2003-386310 filed Nov. 17, 2003, which is hereby incorporated by reference herein.

What is claimed is:

1. A developing apparatus for developing an electrostatic latent image formed on an electrophotographic photosensitive member, said developing apparatus comprising:

a developing roller configured and positioned to develop the electrostatic latent image by use of developer;

a magnetic member provided in said developing roller;

a developing blade comprising a supporting member and a layer thickness regulating member, the supporting member supporting the layer thickness regulating member, the layer thickness regulating member being provided along a longitudinal direction of said developing roller configured and positioned to regulate the layer thickness of the developer adhering to a surface of said developing roller;

a seal member provided outside said layer thickness regulating member in said longitudinal direction in opposed relationship with the surface of said developing roller; and an end portion regulating member comprising a scraping portion and a regulating portion, the scraping portion scraping off the developer from said developing roller, said scraping portion being provided at a location at which in said longitudinal direction, at least a portion thereof overlaps said seal member, and being in contact with said developing roller, the regulating portion regulating the layer thickness of the developer when the layer thickness of the developer passing though an interstice formed between said layer thickness regulating member and said seal member in said longitudinal direction is equal to or greater than a predetermined layer thickness, and permitting passage of said developer when the layer thickness of said developer is less than the predetermined layer thickness, said regulating portion having a gap with respect to the surface of said developing roller, wherein said end portion regulating member comprises a fixed portion fixed to a main body of said developing apparatus, said scraping portion is coupled to said fixed portion, and said regulating portion is coupled to said scraping portion, and wherein a gap is formed between said regulating portion and said fixed portion so that said regulating portion and said fixed portion come do not come into contact with one another, and a gap is formed between said regulating portion and said developing blade so that said regulating portion and said developing blade do not come into contact with one another.

2. A developing apparatus according to claim 1, wherein the gap between said regulating portion and the surface of said developing roller increases from an outside toward an inside of said regulating portion in said longitudinal direction.

3. A developing apparatus according to claim 1, wherein said regulating portion is provided at a location at which at least a portion thereof overlaps said interstice in said longitudinal direction.

4. A developing apparatus according to claim 1, wherein said scraping portion is provided outside said regulating portion with respect to said longitudinal direction.

5. A developing apparatus according to claim 1, wherein said regulating portion and said scraping portion are provided, with respect to a rotating direction of said developing roller, downstream of said layer thickness regulating member and upstream of a developing portion in which said developing roller is opposed to said electrophotographic photosensitive member.

6. A developing apparatus according to claim 1, wherein said scraping portion is provided in such a manner that from an outside toward an inside in said longitudinal direction, the contact portion thereof with said developing roller is inclined toward the downstream side of said developing apparatus with respect to a rotating direction of said developing roller.

7. A developing apparatus according to claim 1, wherein said scraping portion has a damming up portion configured and positioned to dam up the developer on a side of said developing apparatus opposite to a surface contacting said developing roller, so that the developer may not accumulate on said opposite side.

8. A developing apparatus according to claim 1 said regulating portion is protruded from said scraping portion toward an inside in said longitudinal direction.

9. A developing apparatus according to claim 1, wherein the gap between said regulating portion and said developing roller is larger than a gap between said developing roller and the electrophotographic photosensitive member.

10. A process cartridge detachably mountable to a main body of an electrophotographic image forming apparatus, said process cartridge comprising:

an electrophotographic photosensitive member; and a developing apparatus configured and positioned to develop an electrostatic latent image formed on said electrophotographic photosensitive member, said developing apparatus including:

a developing roller configured and positioned to develop the electrostatic latent image by use of developer;

a magnetic member provided in said developing roller;

a developing blade comprising a supporting member and a layer thickness regulating member, the supporting member supporting the layer thickness regulating member, the layer thickness regulating member being provided along a longitudinal direction of said developing roller configured and positioned to regulate a layer thickness of the developer adhering to a surface of said developing roller;

a seal member provided outside said layer thickness regulating member in said longitudinal direction in opposed relationship with the surface of said developing roller; and an end portion regulating member comprising a scraping portion and a regulating portion, the scraping portion scraping off the developer from said developing roller, said scraping portion being provided at a location at which in said longitudinal direction, at least a portion thereof overlaps said seal member, and being in contact with said developing roller, the regulating portion regulating the layer thickness of the developer when the layer thickness of the developer passing through an interstice formed between said layer thickness regulating member and said seal member in said longitudinal direction is equal to or greater than a predetermined layer thickness, and permitting a passage of said developer when the layer thickness of said developer is less than the predetermined layer thickness, said regulating portion having a gap with respect to the surface of said developing roller, wherein said end portion regulating member comprises a fixed portion fixed to a main body of said developing apparatus, said scraping portion is coupled to said fixed portion, and said regulating portion is coupled to said scraping portion, and wherein a gap is formed between said regulating portion and said fixed portion so that said regulating portion and said fixed portion do not come into contact with one another, and a gap is formed between said regulating portion and said developing blade so that said regulating portion and said developing blade do not come into contact with one another.

11. A process cartridge according to claim 10, wherein said regulating portion is protruded from said scraping portion toward an inside in said longitudinal direction.

12. A process cartridge according to claim 11, wherein said scraping portion is provided outside said regulating portion with respect to said longitudinal direction.

13. A process cartridge according to claim 10, wherein the gap between said regulating portion and said developing roller is larger than a gap between said developing roller and the electrophotographic photosensitive member.

14. An end portion regulating member for use in a developing apparatus configured and positioned to develop an electrostatic latent image formed on an electrophotographic photosensitive member, the developing apparatus having a developing roller configured and positioned to carry developer thereon, a magnetic member provided in the developing roller, a developing blade comprising a supporting member and a layer thickness regulating member, the supporting member supporting the layer thickness regulating member, the layer thickness regulating member being provided along the longitudinal direction of the developing roller configured and positioned to regulate the layer thickness of the developer adhering to a surface of the developing roller to a predetermined layer thickness, and a seal member provided outside the layer thickness regulating member with respect to the longitudinal direction in opposed relationship with the surface of the developing roller, said end portion regulating member comprising:

a scraping portion configured and positioned to scrape off the developer from the developing roller, said scraping portion being provided at a location at which in the longitudinal direction, at least a portion thereof overlaps the seal member, and being in contact with the developing roller; and a regulating portion configured and positioned to regulate the layer thickness of the developer when the layer thickness of the developer passing through an interstice formed between the layer thickness regulating member and the seal member is equal to or greater than a predetermined layer thickness, and to permit passage of the developer when the layer thickness of the developer is less than the predetermined layer thickness, said regulating portion having a gap with respect to the surface of the developing roller, wherein said end portion regulating member comprises a fixed portion fixed to a main body of said developing apparatus, said scraping portion is coupled to said fixed portion, and said regulating portion is coupled to said scraping portion, and wherein a gap is formed between said regulating portion and said fixed portion so that said regulating portion and said fixed portion do not come into contact with one another, and a gap is formed between said regulating portion and said developing blade so that said regulating portion and said developing blade do not come into contact with one another.

15. An end portion regulating member according to claim 14, wherein said scraping portion is provided outside said regulating portion with respect to the longitudinal direction.

16. An end portion regulating member according to claim 15, wherein said scraping portion has a damming up portion configured and positioned to dam up the developer on a side opposite to a surface contacting the developing roller, so that the developer does not accumulate on the opposite side.

17. An end portion regulating member according to claim 14, wherein said regulating portion is protruded from said scraping portion toward an inside in said longitudinal direction.

* * * * *

UNITED STATES PATENT AND TRADEMARK OFFICE

CERTIFICATE OF CORRECTION

PATENT NO. : 7,418,225 B2
APPLICATION NO. : 10/985930
DATED : August 26, 2008
INVENTOR(S) : Masanari Morioka et al.

It is certified that error appears in the above-identified patent and that said Letters Patent is hereby corrected as shown below:

ON THE TITLE PAGE, AT ITEM (75)
"Masanari Morioka, Shizouka (JP); Yoshiyuki Batori, Shizouka (JP); Hiroki Ogino, Shizouka (JP)" should read --Masanari Morioka, Shizuoka (JP); Yoshiyuki Batori, Shizuoka (JP); Hiroki Ogino, Shizuoka (JP)--.

COLUMN 1
Line 19, "detachable" should read --detachably--.
Line 23, "resort" should read --resorting--.

COLUMN 3
Line 36, "had" should read --made--.
Line 61, "in" should read --is--.

COLUMN 5
Line 52, "had" should read --made--.
Line 67, "is" should read --are--.

COLUMN 6
Line 1, "members lot" should read --members 10t--.
Line 19, "had" should read --made--.
Line 42, "members lot" should read --members 10t--.

COLUMN 8
Line 22, "has, a" should read --has a--.

COLUMN 12
Line 35, "come" should be deleted.
Line 66, "damming up" should read --damming-up--.

COLUMN 13
Line 4, "claim 1" should read --claim 1, wherein--.

UNITED STATES PATENT AND TRADEMARK OFFICE

CERTIFICATE OF CORRECTION

PATENT NO. : 7,418,225 B2
APPLICATION NO. : 10/985930
DATED : August 26, 2008
INVENTOR(S) : Masanari Morioka et al.

It is certified that error appears in the above-identified patent and that said Letters Patent is hereby corrected as shown below:

COLUMN 14
Line 57, “damming up” should read --damming-up--.

Signed and Sealed this

Tenth Day of February, 2009

JOHN DOLL
*Acting Director of the United States Patent and Trademark Office*